US009120008B2

(12) United States Patent
Shiino et al.

(10) Patent No.: US 9,120,008 B2
(45) Date of Patent: Sep. 1, 2015

(54) GAME APPARATUS

(75) Inventors: Takashi Shiino, Yokohama (JP); Kouji Sasajima, Yokohama (JP); Makiko Sakurai, Tokyo (JP)

(73) Assignee: BANDAI NAMCO GAMES INC., Tokyo (JP)

( * ) Notice: Subject to any disclaimer, the term of this patent is extended or adjusted under 35 U.S.C. 154(b) by 1048 days.

(21) Appl. No.: 13/148,136

(22) PCT Filed: Feb. 17, 2010

(86) PCT No.: PCT/JP2010/052318

§ 371 (c)(1),
(2), (4) Date: Oct. 12, 2011

(87) PCT Pub. No.: WO2010/095633

PCT Pub. Date: Aug. 26, 2010

(65) Prior Publication Data

US 2012/0056381 A1 Mar. 8, 2012

(30) Foreign Application Priority Data

Feb. 19, 2009 (JP) ..... 2009-037067
Feb. 19, 2009 (JP) ..... 2009-037068

(51) Int. Cl.

*A63F 9/30* (2006.01)
*G07F 11/16* (2006.01)
*G07F 17/32* (2006.01)

(52) U.S. Cl.

CPC ..... *A63F 9/30* (2013.01); *G07F 11/165* (2013.01); *G07F 17/3295* (2013.01); *G07F 17/3297* (2013.01); *A63F 2250/144* (2013.01)

(58) Field of Classification Search

CPC ..... A63F 9/00; A63F 9/30; A63F 2250/144; G07F 11/165; G07F 17/3295; G07F 17/3297
USPC ..... 273/447, 448
See application file for complete search history.

(56) References Cited

U.S. PATENT DOCUMENTS

2003/0011133 A1* 1/2003 Uedono et al. ..... 273/447
2005/0218602 A1* 10/2005 Watanabe et al. ..... 273/447

(Continued)

FOREIGN PATENT DOCUMENTS

CN 201061713 Y 5/2008
EP 1 832 319 A1 9/2007

(Continued)

OTHER PUBLICATIONS

Sep. 13, 2011 International Preliminary Report on Patentability issued in International Application No. PCT/JP2010/052318.

(Continued)

*Primary Examiner* — Raleigh W Chiu
(74) *Attorney, Agent, or Firm* — Oliff PLC

(57) ABSTRACT

A game apparatus includes a prize support section that supports a prize, a prize moving section that moves the prize supported by the prize support section by making a movement and a motion, a prize outlet that allows a player to remove the prize, and a prize guiding space that guides the prize toward the prize outlet. The game apparatus further includes a control section that controls the movement and the motion of the prize moving section based on operation information, and controls a motion force of the prize moving section based on motion force information, and a motion force change section that changes the motion force information based on a position of the prize moving section.

15 Claims, 33 Drawing Sheets

(56) References Cited

U.S. PATENT DOCUMENTS

| | | | | |
|---|---|---|---|---|
| 2007/0013139 | A1 | 1/2007 | Kumagai | |
| 2007/0210523 | A1* | 9/2007 | Verstraeten | 273/447 |
| 2012/0025469 | A1* | 2/2012 | Shiino et al. | 273/447 |
| 2012/0056381 | A1* | 3/2012 | Shiino et al. | 273/448 |
| 2014/0015199 | A1* | 1/2014 | Shoemaker, Jr. | 273/447 |

FOREIGN PATENT DOCUMENTS

| | | | | | |
|---|---|---|---|---|---|
| GB | 2 178 328 | A | | 2/1987 | |
| JP | U-3034057 | | | 11/1996 | |
| JP | A-11-319308 | | | 11/1999 | |
| JP | A-2000-70542 | | | 3/2000 | |
| JP | 2002239209 | A | * | 8/2002 | A63F 9/30 |
| JP | A-2003-135842 | | | 5/2003 | |
| JP | A-2003-164662 | | | 6/2003 | |
| JP | 2004097788 | A | * | 4/2004 | A63F 9/30 |
| JP | A-2005-205169 | | | 8/2005 | |
| JP | A-2005-312899 | | | 11/2005 | |
| JP | 2010188012 | A | * | 9/2010 | A63F 9/30 |
| JP | 2012029825 | A | * | 2/2012 | A63F 9/30 |

OTHER PUBLICATIONS

CLENA-FLEX, Namco Bandai Games Inc., National Center for Industrial Property Information and Training, 2008, p. 4.

International Search Report in International Application No. PCT/JP2010/052318; dated May 25, 2010 (with English-language translation).

Extended European Search Report issued in European Patent Application No. 10743759.2 dated Mar. 7, 2013.

* cited by examiner

| | |
|---|---|
| REVERSE | NORMAL |
| REVERSE | NORMAL |

| | |
|---|---|
| REVERSE | NORMAL |
| REVERSE | NORMAL |

| | |
|---|---|
| REVERSE | NORMAL |
| NORMAL | REVERSE |

FIG. 32

| | SETTING VALUE | DECIMAL NUMBER | 32 HEX NUMBER |
|---|---|---|---|
| PRIORITY A | | | |
| ARM POWER RIGHT | 200 STAGES | 1-200 | 01-68 |
| ARM POWER LEFT | 200 STAGES | 1-200 | 01-68 |
| ARM OPENING | 11 STAGES | 00-10 | 0-A |
| ARM POWER SWAP | 16 COMBINATIONS (0000-1111) | 0-15 | 0-F |
| PRIZE PIT | 511 COMBINATIONS (000000001-111111111) | 0-512 | 01-G0 |
| CHARGE SETTING | 32 STAGES | 0-31 | 0-V |
| PRIORITY B | | | |
| MOVEMENT LIMIT X | 0-30 (X-COORDINATE) | 0-30 | 0-U |
| MOVEMENT LIMIT Y | 0-30 (Y-COORDINATE) | 0-30 | 0-U |
| HOME POSITION X | 0-30 (X-COORDINATE) | 0-30 | 0-U |
| HOME POSITION Y | 0-30 (Y-COORDINATE) | 0-30 | 0-U |
| Z-DESCENT LIMIT | 0-200 (Z-COORDINATE) | 0-200 | 00-68 |
| HOME POSITION Z | 0-200 (Z-COORDINATE) | 0-200 | 00-68 |
| PRIORITY C | | | |
| PRIZE COST | NO INPUT / 1-9999 (YEN) | 9999 | 000-90L |
| PAYOUT SUPPORT/SERVICE | OFF / 1-100 (%) / SERVICE | 101 | 00-35 |
| BGM | 5 TYPES | 5 | 0-4 |
| TIMER MODE | 4 TYPES | 4 | 0-3 |
| ERROR SOUND VOLUME | 4 TYPES | 4 | 0-3 |
| RECEIPT OF 500 YEN COIN | OFF／ON | 2 | 0-1 |
| STATION SUSPENSION | OFF／ON | 2 | 0-1 |
| PAYOUT SENSOR | OFF／ON | 2 | 0-1 |
| PRIZE SENSOR | OFF／ON | 2 | 0-1 |
| ARM SIZE SENSOR | OFF／ON | 2 | 0-1 |
| CATCHER ROTATION SENSOR | OFF／ON | 2 | 0-1 |

GAME APPARATUS

TECHNICAL FIELD

The present invention relates to a game apparatus.

BACKGROUND ART

A prize game apparatus including a prize moving section that includes a plurality of arm sections that make an opening/closing motion, moves over a game field, and drops a prize into an open area, has been known.

A prize game apparatus that allows the layout of the game field to be changed has also been known (see JP-A-2005-205169). According to such a prize game apparatus, a game field having a different shape can be formed by arbitrarily changing the placement position of the prize placement section. This makes it possible to provide a prize game apparatus that keeps the player from getting bored. A prize holding section can be caused to make a motion corresponding to the shape of the game field by controlling the motion of the prize holding section.

SUMMARY OF INVENTION

Technical Problem

The above prize game apparatus is designed so that the motion force of each arm section is constant regardless of the position of the prize moving section. Therefore, the effect of the prize moving section on the prize does not change depending on the position of the prize moving section.

A first object of the invention is to provide a game apparatus that is configured so that the effect of the prize moving section on the prize changes depending on the position of the prize moving section.

The layout setting and the motion control setting of the above prize game apparatus created by the operator of one store may be employed in another store so that the layout setting and the motion control setting suitable for the player and the operator can be shared.

In this case, however, it is necessary to explain the layout setting and the motion control setting either orally or via a document.

A second object of the invention is to provide a game apparatus that makes it possible to easily apply an identical setting to a plurality of prize game apparatuses.

Solution to Problem (1-1) One aspect of the invention relates to a prize game apparatus including:

a game field that includes a prize placement area in which a prize is placed, and an open area into which the prize is dropped;

a prize moving section that includes a first arm section and a second arm section that make an opening/closing motion, the prize moving section moving over the game field, and dropping the prize into the open area;

motion force change means that performs a motion force change control process that changes a motion force of the first arm section and a motion force of the second arm section based on a position of the prize moving section; and motion control means that causes the prize moving section to make the opening/closing motion with the motion force changed by the motion force change means.

This makes it possible to change the effect of the prize moving section on the prize depending on the position of the prize moving section.

(1-2) The prize game apparatus may include first driving means that causes the first arm section to make the closing motion, and second driving means that causes the second arm section to make the closing motion, wherein the motion force change means changes a motion force of the first driving means and a motion force of the second driving means.

(1-3) The prize game apparatus may include setting information receiving means that receives setting information including information about the motion force change control process corresponding to the position of the prize moving section, wherein the motion force change means performs the motion force change control process based on the setting information.

This makes it possible to change the effect of the prize moving section on the prize by changing the setting information.

(1-4) In the prize game apparatus, the motion force change means may exchange the motion force of the first arm section and the motion force of the second arm section based on the position of the prize moving section.

This makes it possible to change the effect of the prize moving section on the prize by using only the information about whether or not to exchange the motion force.

(1-5) In the prize game apparatus, the game field may be formed so that a layout of the open area can be changed.

According to this configuration, a wide variety of game playability can be implemented by appropriately combining the layout of the game field and the motion force change of the prize moving section.

(1-6) The prize game apparatus may include a code rule information storage section that stores code rule information that specifies a relationship between a code that consists of a plurality of symbols and the setting information, and a display control section that displays the code on a display section based on the code rule information and the setting information received by the setting information receiving means.

According to this configuration, the information about the motion force of the first arm section and the information about the motion force of the second arm section set to one game apparatus can be easily set to another game apparatus by displaying the code that consists of a plurality of symbols based on the setting information.

(1-7) The prize game apparatus may include code input receiving means that receives a code that consists of a plurality of symbols, and a code rule information storage section that stores code rule information that specifies a relationship between the setting information and the code, wherein the setting information receiving means receives the setting information based on the input code.

According to this configuration, the information about the motion force of the first arm section and the information about the motion force of the second arm section set to one game apparatus can be easily set to another game apparatus by receiving the setting information based on the code that consists of a plurality of symbols.

(1-8) Another aspect of the invention relates to a game apparatus including:

a prize outlet that allows a player to remove a prize;

a prize guiding space that guides the prize toward the prize outlet;

a prize support section that supports the prize over the prize guiding space;

a prize moving section that makes a movement and a motion over the prize guiding space;

a control section that controls the movement and the motion of the prize moving section based on operation information, and controls a motion force of the prize moving section based on motion force information; and a motion force change section that changes the motion force information, the prize moving section including a first motion section that makes a motion in a first direction;

the control section controlling the motion force of the first motion section based on the first motion force information; and the motion force change section changing the first motion force information based on a position of the prize moving section.

(1-9) In the game apparatus, the motion force change section may change the first motion force information in a change state corresponding to the position of the prize moving section.

(1-10) The game apparatus may further include a setting section that sets setting information about the change state corresponding to the position of the prize moving section based on input information, wherein the motion force change section changes the first motion force information in the change state corresponding to the position of the prize moving section based on the setting information.

(1-11) In the game apparatus, the prize moving section may further include a second motion section that makes a motion in a second direction, the control section may control a motion force of the second motion section based on second motion force information, and the motion force change section may change the second motion force information based on the position of the prize moving section.

(1-12) In the game apparatus, the motion force change section may change the second motion force information in a change state corresponding to the position of the prize moving section.

(1-13) The game apparatus may further include a setting section that sets setting information about the change state corresponding to the position of the prize moving section based on input information, wherein the motion force change section changes the second motion force information in the change state corresponding to the position of the prize moving section based on the setting information.

(1-14) In the game apparatus, the motion force change section may change the second motion force information so that the motion force of the first motion section decreases when changing the first motion force information so that the motion force of the first motion section increases, and may change the second motion force information so that the motion force of the second motion section increases when changing the first motion force information so that the motion force of the first motion section decreases.

(1-15) In the game apparatus, the motion force change section may exchange the first motion force information and the second motion force information based on the position of the prize moving section.

(1-16) In the game apparatus, the first direction may be opposite to the second direction.

(1-17) The game apparatus may further include a detection section that detects the position of the prize moving section, (1-18) The game apparatus may further include a placement section, the prize support section being placed on the placement section so that placement of the prize support section can be changed over the prize guiding space.

(1-19) The game apparatus may further include a setting section that sets setting information based on input information, a rule information storage section that stores rule information that specifies a control code corresponding to each of the plurality of pieces of setting information, and a display control section that displays the control code corresponding to the input information on a display section based on the input information and the rule information, wherein the motion force change section changes the first motion force information based on the setting information.

(1-20) The game apparatus may further include a rule information storage section that stores rule information that specifies a control code corresponding to each of a plurality of pieces of setting information, a setting section that sets the setting information based on the input control code, and a control section that controls at least one of the movement and the motion of the prize moving section based on operation information and the setting information, wherein the motion force change section changes the first motion force information based on the setting information.

(2-1) Another aspect of the invention relates to a prize game apparatus including:

a game field that includes a prize placement area in which a prize is placed, and an open area into which the prize is dropped, the game field being formed so that a layout of the open area can be changed;

a prize moving section that moves over the game field, and drops the prize into the open area;

a code rule information storage section that stores code rule information that specifies a relationship between setting information including information about the layout of the open area and a code that consists of a plurality of symbols;

setting information receiving means that receives the setting information;

motion control means that controls a motion of the prize moving section based on the setting information; and display control means that displays the code on a display section based on the code rule information and the setting information received by the setting information receiving means.

According to this configuration, the motion control setting corresponding to the layout of one game apparatus can be easily set to another game apparatus by displaying the code that consists of a plurality of symbols based on the setting information.

(2-2) The prize game apparatus may include a detection section that detects the layout of the open area, wherein the setting information receiving section receives information about the layout based on a detection result of the detection section.

This makes it possible to receive the information about the layout even if the operator does not perform a setting operation.

(2-3) Another aspect of the invention relates to a prize game apparatus including:

a game field that includes a prize placement area in which a prize is placed, and an open area into which the prize is dropped, the game field being formed so that a layout of the open area can be changed;

a prize moving section that moves over the game field, and drops the prize into the open area;

a code rule information storage section that stores code rule information that specifies a relationship between setting information including information about the layout of the open area and a code that consists of a plurality of symbols;

code input receiving means that receives the code;

setting information receiving means that receives the setting information based on the code rule information and the code received by the code input receiving means; and motion control means that controls a motion of the prize moving section based on the setting information.

According to this configuration, the motion control setting corresponding to the layout of one game apparatus can be easily set to another game apparatus by receiving the setting information based on the code that consists of a plurality of symbols.

(2-4) The prize game apparatus may include a detection section that detects the layout of the open area, and a comparison section that compares a detection result of the detection section with information about the layout included in the setting information generated by the setting information generation means.

This makes it possible to determine whether or not the actual layout coincides with the setting information.

(2-5) In the prize game apparatus, the prize moving section may include a first arm section and a second arm section, the first arm section and the second arm section may make an opening/closing motion, and the code rule information storage section may store code rule information that specifies a relationship between information about a motion force of the first arm section and information about a motion force of the second arm section, and the code.

This makes it possible to indicate the information about the layout, the information about the motion force of the first arm section, and the information about the motion force of the second arm section by using a single code.

(2-6) Another aspect of the invention relates to a game apparatus including:

a prize support section that supports a prize;

a prize outlet that allows a player to remove the prize;

a prize guiding space that guides the prize toward the prize outlet;

a prize moving section that moves the prize by making at least one of a movement and a motion;

a control section that controls at least one of the movement and the motion of the prize moving section based on operation information and setting information;

a setting section that sets the setting information based on input information;

a rule information storage section that stores rule information that specifies a control code corresponding to each of a plurality of pieces of the setting information; and a display control section that displays the control code corresponding to the input information on a display section based on the input information and the rule information.

(2-7) The game apparatus may further include a placement section, the prize support section being placed on the placement section so that placement of the prize support section can be changed over the prize guiding space, wherein the control section controls at least one of the movement and the motion of the prize moving section based on placement setting information about placement of the prize support section;

wherein the setting section sets the placement setting information based on the input information; and wherein the rule information storage section stores rule information that specifies a control code corresponding to each of a plurality of pieces of the placement setting information.

(2-8) The game apparatus may further include a detection section that detects the position of the prize moving section, wherein the setting section sets the placement setting information based on a detection result of the detection section.

(2-9) The game apparatus may further include:

a motion force control section that controls a motion force of the prize moving section based on motion force information; and a motion force change section that changes the motion force information, wherein the motion force change section changes the motion force information based on motion force setting information about the motion force;

wherein the setting section sets the motion force setting information based on the input information; and wherein the rule information storage section stores rule information that specifies a control code corresponding to each of a plurality of pieces of the motion force setting information.

(2-10) The game apparatus may further include:

a motion force control section that controls a motion force of the prize moving section based on motion force information; and a motion force change section that changes the motion force information in a change state corresponding to the position of the prize moving section, wherein the motion force change section changes the motion force information based on change state setting information about the change state corresponding to the position of the prize moving section;

wherein the setting section sets the change state setting information based on the input information: and wherein the rule information storage section stores rule information that specifies a control code corresponding to each of a plurality of pieces of the change state setting information.

(2-11) The game apparatus may further include:

a motion force control section that controls a motion force of a first motion section of the prize moving section based on first motion force information, and controls a motion force of a second motion section of the prize moving section based on second motion force information; and a motion force change section that changes the first motion force information and the second motion force information in a change state corresponding to the position of the prize moving section, wherein the motion force change section changes the first motion force information and the second motion force information based on change state setting information about the change state corresponding to the position of the prize moving section;

wherein the setting section sets the change state setting information based on the input information; and wherein the rule information storage section stores rule information that specifies a control code corresponding to each of a plurality of pieces of the change state setting information.

(2-12) Another aspect of the invention relates to a game apparatus including:

a prize support section that supports a prize;

a prize outlet that allows a player to remove the prize;

a prize guiding space that guides the prize toward the prize outlet;

a prize moving section that moves the prize by making at least one of a movement and a motion;

a rule information storage section that stores rule information that specifies a control code corresponding to each of a plurality of pieces of setting information;

a setting section that sets the setting information based on the input control code; and a control section that controls at least one of the movement and the motion of the prize moving section based on operation information and the setting information.

(2-13) The game apparatus may further include:

a placement section, the prize support section being placed on the placement section so that placement of the prize support section can be changed over the prize guiding space, wherein the rule information storage section stores rule information that specifies a control code corresponding to each of a plurality of pieces of placement setting information about placement of the prize support section;

wherein the setting section sets the placement setting information based on the input control code; and wherein the control section controls at least one of the movement and the motion of the prize moving section based on the placement setting information.

(2-14) The game apparatus may further include a detection section that detects the position of the prize moving section, wherein the setting section sets the placement setting information based on a detection result of the detection section.

(2-15) The game apparatus may further include:

a motion force control section that controls a motion force of the prize moving section based on motion force information; and a motion force change section that changes the motion force information, wherein the rule information storage section stores rule information that specifies a control code corresponding to each of a plurality of pieces of motion force setting information about the motion force;

wherein the setting section sets the motion force setting information based on the input control code; and wherein the motion force change section changes the motion force information based on the motion force setting information.

(2-16) The game apparatus may further include:

a motion force control section that controls a motion force of the prize moving section based on motion force information; and a motion force change section that changes the motion force information in a change state corresponding to the position of the prize moving section, wherein the rule information storage section stores rule information that specifies a control code corresponding to each of a plurality of pieces of change state setting information about the change state corresponding to the position of the prize moving section;

wherein the setting section sets the change state setting information based on the input control code; and wherein the motion force change section changes the motion force information based on the change state setting information.

(2-17) The game apparatus may further include:

a motion force control section that controls a motion force of a first motion section of the prize moving section based on first motion force information, and controls a motion force of a second motion section of the prize moving section based on second motion force information; and a motion force change section that changes the first motion force information and the second motion force information in a change state corresponding to the position of the prize moving section, wherein the rule information storage section stores rule information that specifies a control code corresponding to each of a plurality of pieces of change state setting information about the change state corresponding to the position of the prize moving section;

wherein the setting section sets the change state setting information based on the input control code; and wherein the motion force change section changes the first motion force information and the second motion force information based on the change state setting information.

BRIEF DESCRIPTION OF DRAWINGS

FIG. 32 is a table illustrating an example of setting information according to one embodiment of the invention.

DESCRIPTION OF EMBODIMENTS

1. Basic Configuration of Prize Game Apparatus

Figure 1:
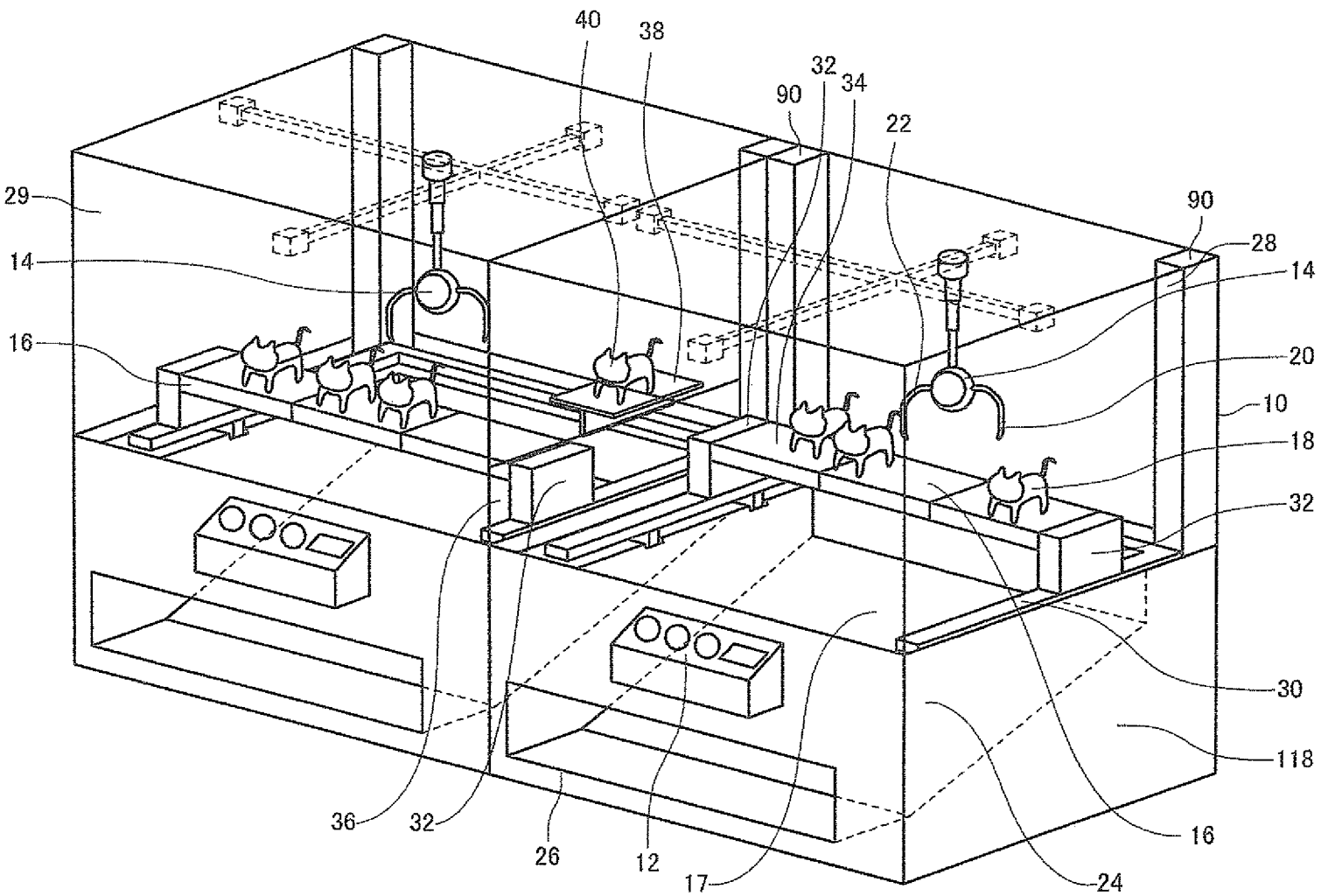
FIG. 1 is a perspective view illustrating an example of a prize game apparatus according to one embodiment of the invention.

FIG. 1 illustrates an example of a prize game apparatus 10 according to one embodiment of the invention. The player moves a prize moving section 14 by operating an operation section 12, holds a prize 18 placed (i.e., supported) in a prize placement area 16 by opening and closing a right arm section 20 (i.e., first motion section) and a left arm section 22 (i.e., second motion section), transfers the prize 18 to an open area 17, and drops the prize 18 by opening the right arm section 20 and the left arm section 22 over the open area 17 to acquire the prize 18. The right arm section 20 makes a closing motion when the right arm section 20 is rotated in the clockwise direction (i.e., caused to make a motion in a first direction), and the left arm section 22 makes a closing motion when the left arm section 22 is rotated in the counterclockwise direction (i.e., caused to make a motion in a second direction opposite to the first direction). The prize moving section 14 may move the prize by making at least one of a movement and a motion. The prize game apparatus 10 according to one embodiment of the invention includes a game field, a prize guiding space 24, and a prize outlet 26.

As illustrated in FIG. 1, the upper part of the housing of the prize game apparatus 10 is formed using a transparent plate (e.g., acrylic plate) so that the player can observe the internal state of the prize game apparatus 10, but cannot touch the inside of the prize game apparatus 10. A game space 28 is thus formed inside the housing. The lower side of the game space 28 serves as the game field. The operator can open and close the front side and the right/left side of the upper half of the housing, and can place the prizes 18 inside the game space 28, for example.

The game field (game space 28) includes the prize placement area 16 that serves as a placement area for the prizes 18, and the open area 17 that serves as a prize dropping area. The game field may also include an obstacle (e.g., wall or mountain) formation area in addition to the prize placement area 16 and the open area 17. The prize guiding space 24 is provided under the game field, the upper area of the prize guiding space 24 being open in a rectangular shape over a range corresponding to almost the entire area of the game field. The prize guiding space 24 communicates with the prize outlet 26 that is provided in the front side of the lower part of the housing so that the player can remove the prize. Specifically, the prize guiding space 24 guides the prize to the prize outlet 26.

A first base section 30 (i.e., placement section) is provided over the outer edge of the prize guiding space 24. A support section 32 (i.e., placement section) is attached to the upper side of the first base section 30 positioned on the left side (i.e., one side of the prize guiding space) and the right side (i.e., the other side of the prize guiding space) of the first base section 30, and three prize placement sections 34 (i.e., prize support sections) are connected between the upper area of the side of the left support section 32 and the upper area of the side of the right support section 32. The prize placement area 16 is formed by the upper side of the prize placement sections 34. The prize game apparatus 10 according to one embodiment of the invention is thus configured so that the placement of the prize placement section 34 can be changed over the prize guiding space 24, and a three-dimensional prize placement area 16 can be formed over the prize guiding space 24 by combining the support sections 32 and the prize placement sections 34 over the first base section 30.

The open area 17 is an area where the prize placement section 34 is not disposed, and communicates with the prize guiding space 24. Therefore, the prize 18 that has fallen into the open area 17 reaches the prize outlet 26 through the prize guiding space 24, and the player removes the prize 18.

According to one embodiment of the invention, the first base section 30 supports a plurality of support sections 32 over the outer edge of the prize guiding space 24, and the support sections 32 support the prize placement sections 34 over the prize guiding space 24. The prize placement sections 34 thus support the prizes 18 over the prize guiding space 24. An area of the game space 28 where the prize placement sections 34 are disposed serves as the prize placement area 16, and an area of the game space 28 where the prize placement section 34 is not disposed serves as the open area 18 through which the prize falls into the prize guiding space 24. Therefore, it is also possible to provide a plurality of prize placement areas 16 separated by the open area 17.

In one embodiment of the invention, the prizes may be separately placed on a plurality of prize placement areas 16, or a large prize may be supported over the prize guiding space 24 so that the prize is placed on one prize placement area 16 and leans against another prize placement area. The player can drop the prize into the prize guiding space 24 by causing the right arm section 20 and the left arm section 22 that hold the prize to move to a position over the open area 17 and release the prize over the open area 17. A prize also falls into the prize guiding space 24 when the prize moving section 14 comes in contact with the prize when the prize moving section 14 moves in the forward, backward, rightward, or leftward direction, or when the prize moving section 14 comes in contact with the prize when the prize moving section 14 moves in the downward direction, or when the right arm section 20 or the left arm section 22 comes in contact with the prize when the right arm section 20 and the left arm section 22 are opened or closed. Therefore, the open area 17 refers to an area that is defined by projecting an area other than the prize placement area 16 onto the bottom of the game space 28, and also refers to an area that allows the prize to pass through and is three-dimensionally formed in the game space 28.

Note that the forward, backward, rightward, and leftward moving range of the prize moving section 14 corresponds to the open area of the prize guiding space 24. Therefore, the prize moving section 14 can move to a position over the open area 17 and perform a release motion irrespective of the position of the open area 17 formed over the prize guiding space 24.

As illustrated in FIG. 1, two prize game apparatuses 10 according to one embodiment of the invention may be connected. The lower part of the right game space 28 and the lower part of the left game space 29 are partitioned by a partition 36. A center display area 38 is formed over the partition 36. The center display area 38 is positioned outside the moving ranges of the right and left prize moving sections 14, and the player cannot acquire a prize 40 placed in the center display area 38.

2. Structure Inside Game Space 2-1. First Base Section

Figure 2A:
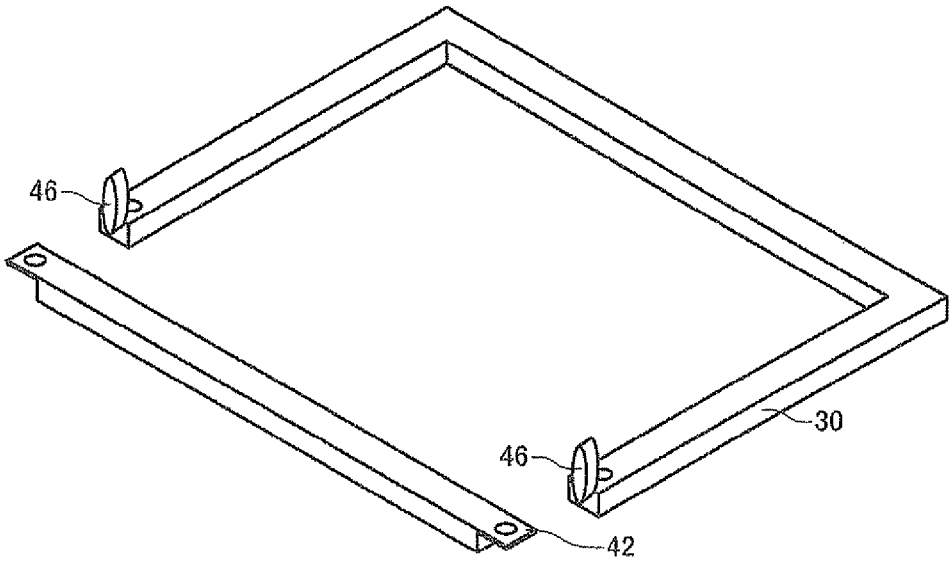
FIG. 2A is a diagram illustrating a first base section according to one embodiment of the invention.
Figure 2B:
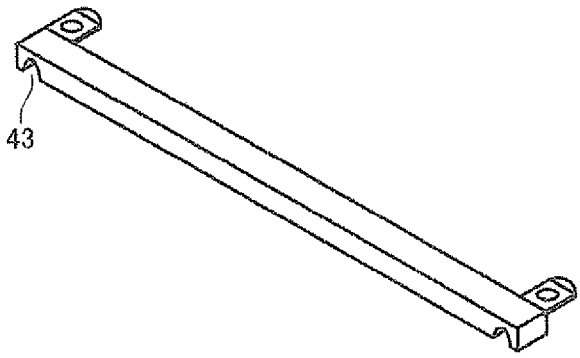
FIG. 2B is a diagram illustrating a first base section according to one embodiment of the invention.

FIGS. 2A to 2B are perspective views illustrating the first base section 30 according to one embodiment of the invention. The first base section 30 is a frame member from which a front bar 42 can be removed. When removing the front bar 42 from the first base section 30, the first base section 30 is open on the front side. As illustrated in FIG. 2A, each end of the bar 42 is formed in the shape of a plate. The plate-like ends of the bar 42 can be placed on the front end of the first base section 30. The bar 42 is secured on the first base section 30 by inserting a screw into a hole formed in the end of the first base section 30 and a hole formed in the plate-like end of the bar 42. The bar 42 can thus be secured on the first base section 30 that is provided with a lever 46 at the front end thereof.

FIG. 2B illustrates another example of the bar. The bar illustrated in FIG. 2B is configured so that a plate-like member that is attached to the first base section 30 is provided on the side of each end of the bar. A depression 43 is formed in the lower part of each end of the bar. The lever 46 can be moved in the forward direction. Specifically, the shaft of the lever 46 that has been moved in the forward direction is fitted into the depression 43, and the plate-like member is placed on the front end of the first base section 30, and screwed to the first base section 30 so that the bar can be secured on the front end of the first base section 30.

Figure 3:
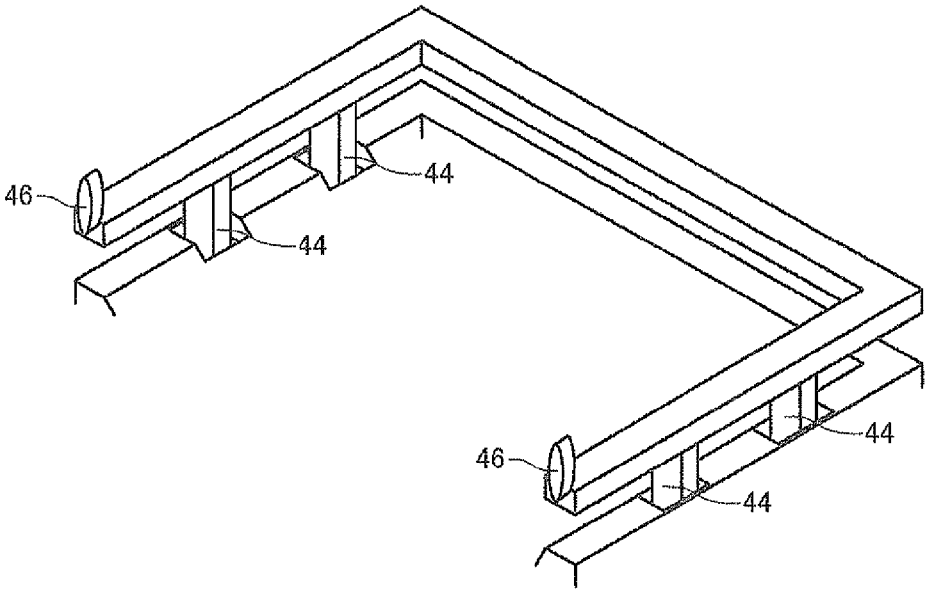
FIG. 3 is a diagram illustrating a first base section according to one embodiment of the invention.

FIG. 3 is a perspective view illustrating the outer edge (peripheral area) of the prize guiding space 24. As illustrated in FIG. 3, two pillar members 44 extend upward from the bottom of the housing on each side of the prize guiding space 24 so as to avoid the prize guiding space 24. The upper end of each pillar member 44 is connected to the first base section 30. Each pillar member 44 can move upward and downward relative to the housing. This makes it possible to change the height of the first base section 30 inside the game space 28. The lock levers 46 are respectively provided on the left front end and the right front end of the first base section 30. When the right and left levers 46 extend in the vertical direction, the pillar members 44 cannot move upward and downward relative to the housing (locked state), so that the first base section 30 is stably secured on the housing. When the right and left levers 46 have been operated sideways, the locked state of the pillar members 44 is canceled, so that the height of the first base section 30 can be changed by moving (pulling or pushing) the first base section 30 upward or downward. The pillar members 44 are graduated so that the height of the first base section 30 can be determined.

Note that the lower limit of the height of the first base section 30 may be higher than the upper end of the front side of the lower part of the housing illustrated in FIG. 1. This prevents a situation in which the operator catches the finger between the first base section 30 and the front side of the lower part of the housing when the bar 42 is attached to the first base section 30 due to downward movement of the first base section 30.

2-2. Support Section

Figure 4:
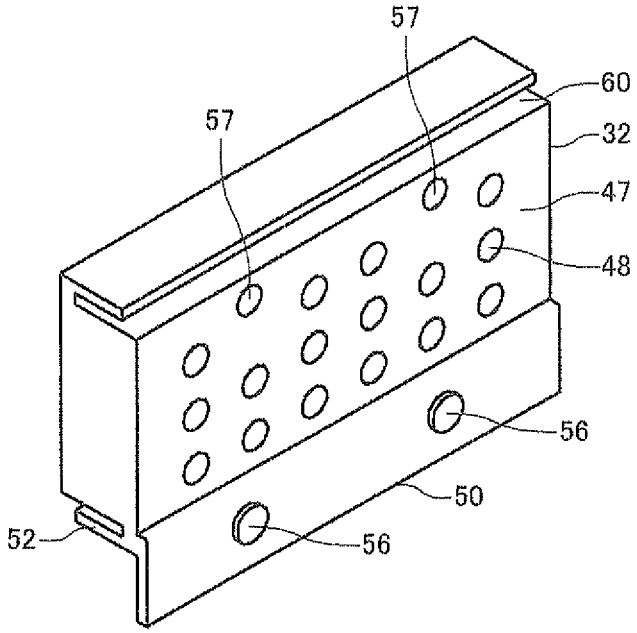
FIG. 4 is a diagram illustrating a support section according to one embodiment of the invention.

FIG. 4 is a diagram illustrating the support section 32 according to one embodiment of the invention. A main body 47 of the support section 32 is formed in the shape of a rectangular parallelepiped. A plurality of holes 48 are formed in the largest side (i.e., an attachment side provided with a second attachment section) of the main body 47. A rectangular attachment plate 50 (extension section) having a side parallel to the side of the main body 47 extends downward from the lower end of the side of the main body 47. A rectangular slide plate 52 (i.e., guide target section) is formed at the lower end of the side of the main body 47 so that the slide plate 52 protrudes parallel to the bottom of the main body 47. The distance between the slide plate 52 and the bottom of the main body 47 (i.e., first base guide section) is greater to some extent than the thickness of the slide plate 52.

Figure 5:
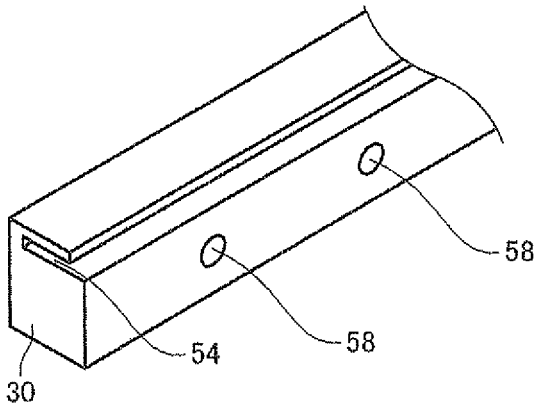
FIG. 5 is a diagram illustrating the end of a first base section according to one embodiment of the invention.

Attachment of the support section 32 to the first base section 30 is described below with reference to FIGS. 5 and 6. FIG. 5 is an enlarged view illustrating the left front end of the first base section 30 in a state in which the front bar 42 is removed. As illustrated in FIG. 5, a first groove 54 (i.e., first base guide section) is formed in the upper part of the first base section 30 so that the first groove 54 is parallel to the upper side of the first base section 30. When the first groove 54 is formed parallel to the upper side of the first base section 30, a deterioration in appearance (e.g., the groove becomes dirty) can be suppressed as compared with the case where the first groove 54 is formed perpendicularly to the upper side of the first base section 30. Note that the right front end of the first base section 30 has a shape similar to that of the left front end of the first base section 30.

Figure 6:
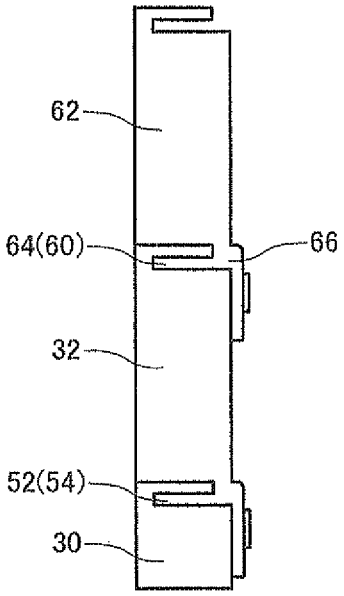
FIG. 6 is a diagram illustrating attachment of a support section according to one embodiment of the invention.

FIG. 6 is a cross-sectional view illustrating a state in which the support section 32 is attached to the first base section 30. As illustrated in FIG. 6, the upper part of the first base section 30 engages the bottom of the main body 47 by fitting the slide plate 52 into the first groove 54, so that the support section 32 can be temporarily and slidably placed on the first base section 30. Specifically, the first groove 54 slidably guides the support section 32 disposed on one side of the prize guiding space 24 along one side of the prize guiding space 24, and slidably guides the support section 32 disposed on the other side of the prize guiding space 24 along the other side of the prize guiding space 24. The slide plate 52 is guided by the first groove 54 in the lower part of the support section 32.

Figure 7:
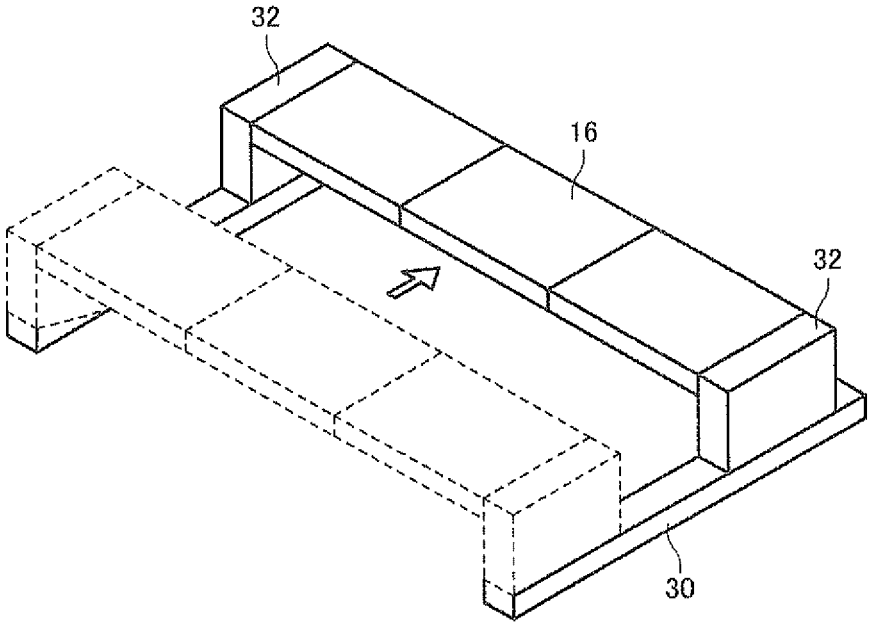
FIG. 7 is a diagram illustrating the slide movement of a support section according to one embodiment of the invention.

Therefore, the prize placement area 16 assembled on the front side of the first base section 30 can be slid to the interior side of the first base section 30, as illustrated in FIG. 7. The prize placement area 16 can be easily formed on the front side of the game space (e.g., the left game space 29 illustrated in FIG. 1). However, it is difficult to form the prize placement area 16 on the interior side of the game space (e.g., the right game space 28 illustrated in FIG. 1). Specifically, the operator must lean forward in an unstable way in order to form the prize placement area 16 on the interior side of the game space. The slide movement illustrated in FIG. 7 makes it possible to reduce the burden imposed on the operator when forming the prize placement area 16 on the interior side of the game space, and placing the prizes on the prize placement area 16 positioned on the interior side of the game space.

The prize placement area 16 illustrated in FIG. 7 may bend downward due to the weight of the prize placement area 16 and the weight of the prizes placed on the prize placement area 16. In this case, force is applied to the upper side of the first base section since the support section 32 inclines inward. If the support section 32 is attached to the first base section using only the attachment plate 50, the bottom of the support section 32 is removed from the first base section due to inclination of the support section 32. A situation in which the bottom of the support section 32 is removed from the first base section can be prevented by employing the engagement structure of the slide plate 52 and the first groove 54 in addition to the attachment plate 50. Moreover, the first groove 54 is formed from the inner side of the first base section 30 toward the outer side of the first base section 30 taking account of the resistance to inclination of the support section 32 that may occur when the prize placement area 16 bends downward. This makes it possible to increase the resistance to the inward force as compared with the case where the first groove 54 is formed from the outer side of the first base section 30 toward the inner side of the first base section 30.

Moreover, the support section 32 easily engages the first base section 30 when the first groove 54 is formed from the inner side of the first base section 30 toward the outer side of the first base section 30. For example, the support section 32 can be caused to engage the first base section 30 by attaching the prize placement area 16 to the support section 32 in an area outside the game space, and bending the prize placement area 16.

As illustrated in FIG. 4, two threaded holes 56 (i.e., first attachment sections) are formed in the attachment plate 50. As illustrated in FIG. 5, a plurality of threaded holes 58 (i.e., third attachment sections) are formed in the inner side of the first base section 30 at the same interval as that between the threaded holes 56 formed in the attachment plate 50. The support section 32 is attached to the first base section 30 by slidingly positioning the support section 32, and inserting a screw into the threaded hole 58 formed in the inner side of the first base section 30 and the threaded hole 56 formed in the attachment plate 50. Specifically, the threaded holes 56 and 58 are used to removably attach the support section 32 to the first base section 30. The attachment position of the support section 32 on the first base section 30 can be determined based on the threaded hole into which a screw has been inserted. Therefore, the attachment position of the support section 32 can be reproduced by recording the threaded hole into which a screw has been inserted.

As illustrated in FIG. 4, two threaded holes 57 (i.e., second attachment sections) are formed in the upper part of the side of the main body 47. The interval between the threaded holes 56 formed in the attachment plate 50 is equal to the interval between the threaded holes 57 formed in the upper part of the side of the main body 47. The prize placement section 34 can be attached to the upper part of the side of the main body 47 by utilizing the second attachment section 57. Specifically, the threaded holes 57, 56, and 58 are used to removably attach the prize placement section 34 to the support section 32. Since the main body 47 has a certain height, and the first attachment section 56 and the second attachment section 57 are disposed at a certain distance, a game field having a three-dimensional shape can be formed. In the example illustrated in FIG. 1, the attachment plate 50 of the main body 47 is attached to the first base section 30, and the prize placement section 34 is attached to the upper part of the side of the main body 47, so that the prize placement section 34 is supported above the upper side of the first base section 30 at a height corresponding to the height of the main body 47.

As illustrated in FIG. 4, a second groove 60 (i.e., support guide section) having the same shape as that of the first groove 54 is twined in the upper part of the main body 47 of the support section 32. As illustrated in FIG. 6, a slide plate 64 of another support section 62 (i.e., guide target section) is fitted into the second groove 60 so that the upper part of the main body of the support section 32 engages the bottom of the main body of the support section 62. The second groove 60 thus slidably guides the support section 62. The slide plate 64 of the support section 62 is guided by the second groove 60. The support section 62 is secured on the support section 32 by inserting a screw into the threaded hole 57 formed in the upper part of the side of the main body of the support section 32 and the threaded hole 56 formed in the attachment plate 66 of the support section 62. Specifically, the threaded hole 56 is used to removably attach the support section 32 to the support section 62, and the threaded hole 57 is used to removably attach the support section 62 to the support section 32.

A plurality of support sections can be connected by designing the first base section 30 and the support section 32 so that the upper part of the first base section 30 and the upper part of the main body of the support section 32 have an identical shape. This makes it possible to change the height of the support section, so that various prize placement areas having a three-dimensional shape can be formed.

2-3. Prize Placement Section

Figure 8:
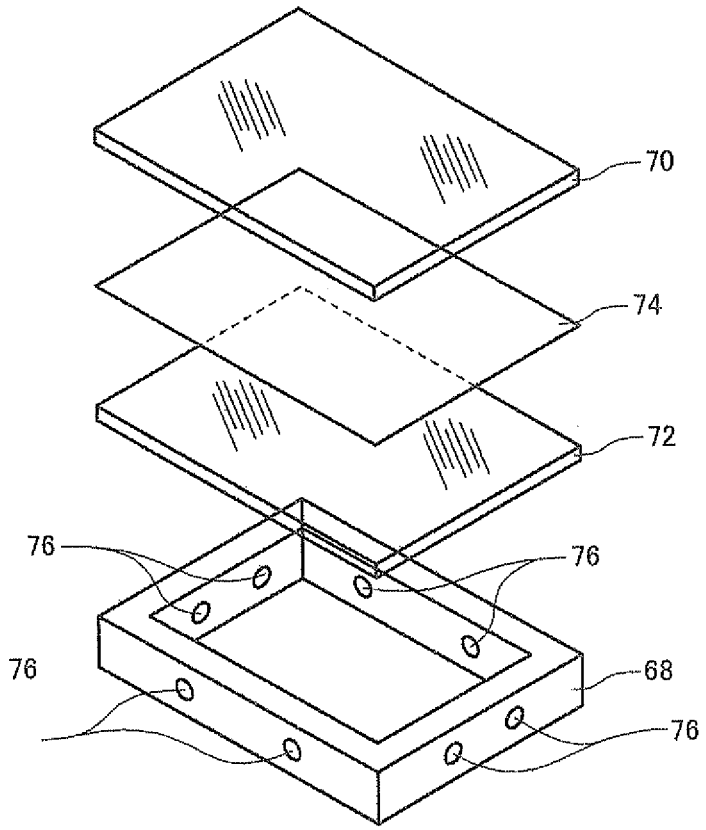
FIG. 8 is a diagram illustrating a prize placement section according to one embodiment of the invention.

FIG. 8 is a diagram illustrating the prize placement section 34 according to one embodiment of the invention. As illustrated in FIG. 8, the prize placement section 34 includes a frame member 68, a first plate-like member 70 on which the prize is placed, a second plate-like member 72 disposed under the first plate-like member 70, and a sheet 74 disposed between the first plate-like member 70 and the second plate-like member 72. The prize placement section of a related-art prize game apparatus is configured so that the prize placement side cannot be removed from the frame member. The prize placement section 34 according to one embodiment of the invention is configured so that the plate-like member can be removed from the frame member 68, and is supported by the frame member 68.

Figure 9:
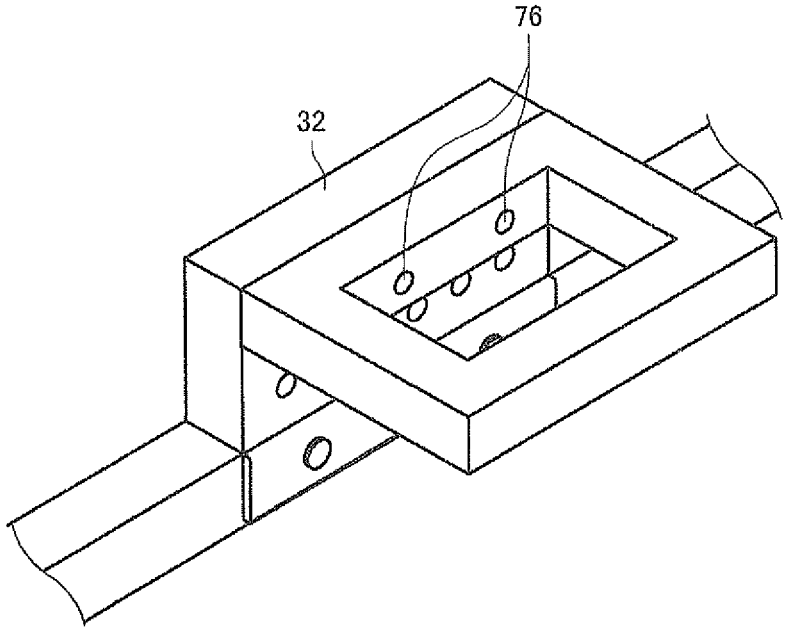
FIG. 9 is a diagram illustrating attachment of a frame member according to one embodiment of the invention.

Attachment of the frame member 68 is described below with reference to FIG. 9. The frame member 68 supports the first plate-like member 70, the second plate-like member 72, and the sheet 74 inside the game space. Two threaded holes 76 (frame-side attachment sections) are formed in each side of the frame member 68. The frame member 68 is attached to the support section 32 inside the game space by inserting a screw into the frame-side attachment section and the apparatus-side attachment section (first attachment section 56, second attachment section 57, or third attachment section 58). FIG. 9 illustrates an example in which the frame member 68 is attached to the upper part of the side of the support section 32.

As illustrated in FIG. 8, the prize placement section 34 is configured so that the frame member 68, the first plate-like member 70, the second plate-like member 72, and the sheet 74 can be separated. Therefore, the frame member 68 can be screwed to the support section 32 from above by removing the first plate-like member 70, the second plate-like member 72, and the sheet 74.

Figure 10A:
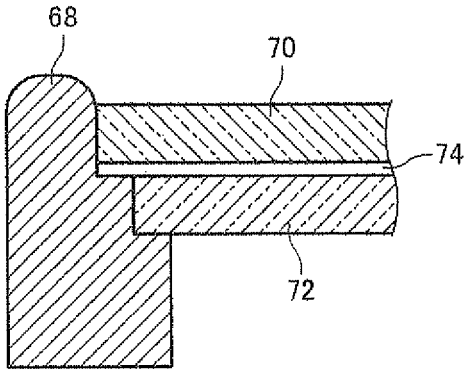
FIG. 10A is a diagram illustrating support of a plate-like member according to one embodiment of the invention.
Figure 10B:
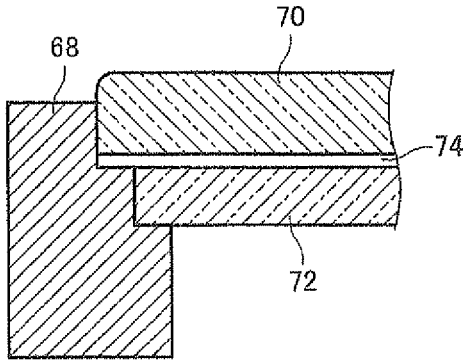
FIG. 10B is a diagram illustrating support of a plate-like member according to one embodiment of the invention.
Figure 10C:
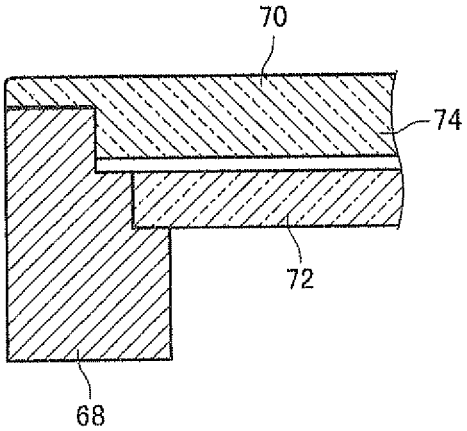
FIG. 10C is a diagram illustrating support of a plate-like member according to one embodiment of the invention.
Figure 10D:
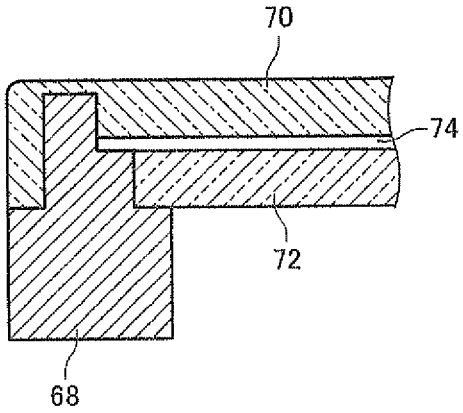
FIG. 10D is a diagram illustrating support of a plate-like member according to one embodiment of the invention.

FIGS. 10A to 10D are cross-sectional views illustrating an example in which the first plate-like member 70, the second plate-like member 72, and the sheet 74 are supported by the frame member 68. As illustrated in FIGS. 10A to 10D, the inner side of the frame member 68 has a step-like cross-sectional shape. The step-like inner side of the frame member 68 serves as a fitting section for the plate-like member and the sheet. As illustrated in FIGS. 10A and 10B, when the first plate-like member is supported by the frame member 68 at a position inward from the outer side of the frame member 68, it is possible to prevent a situation in which the arm section lifts the end of the plate-like member when the arm section holds the prize via an opening/closing operation.

As illustrated in FIGS. 10A to 10D, the first plate-like member 70 and the second plate-like member 72 differ in size. Therefore, the operator can easily distinguish the first plate-like member 70 and the second plate-like member 72. In one embodiment of the invention, only the first plate-like member 70 has a surface provided with an anti-scratch finish. In this case, if the second plate-like member 72 is disposed on the first plate-like member 70 by mistake, the first plate-like member 70 may be damaged. Such a situation can be prevented by utilizing the first plate-like member 70 and the second plate-like member 72 that differ in size.

The first plate-like member 70 and the second plate-like member 72 are formed using a transparent acrylic plate, for example. The sheet 74 may be a sheet on which a pattern or a character is drawn, or may be a mirror-finish sheet, for example. The appearance of the prize placement section 34 can be easily changed by placing such a sheet between transparent acrylic plates. In particular, the player is given an impression that the number of prizes is larger than the actual number of prizes placed on the prize placement section 34 when placing a mirror-finish sheet between transparent acrylic plates.

2-4. Arm Stop Member

Figure 11:
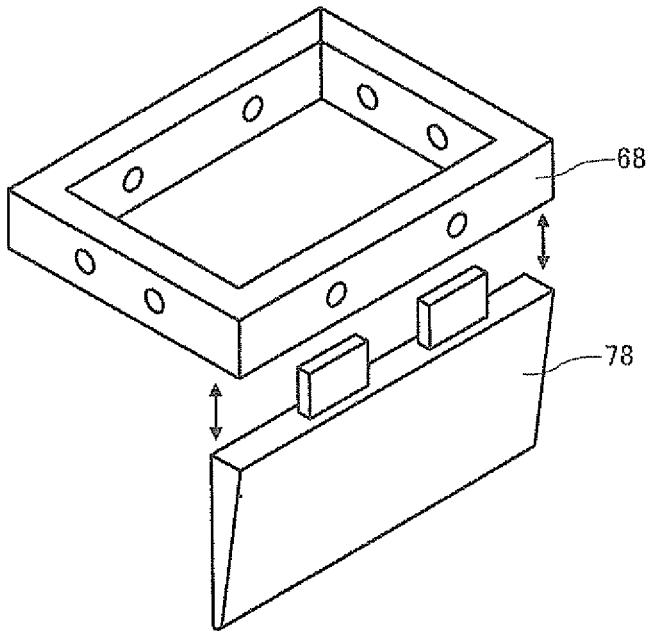
FIG. 11 is a diagram illustrating an arm stop member according to one embodiment of the invention.

FIG. 11 is a diagram illustrating an arm stop member 78 attached to the frame member 68. The arm stop member 78 has a triangular prism shape. When the arm stop member 78 is attached to the bottom of the frame member 68, the arm section does not reach the lower end of the arm stop member. This prevents a situation in which the arm section catches the bottom of the frame member 68 via an opening/closing operation, and lifts the frame member 68. The arm stop member 78 can be removably attached to each side of the frame member 68. Specifically, the arm stop member 78 can be attached to the frame member 68 at a position at which the frame member 68 may be caught by the arm section. For example, the arm stop member 78 may be attached to the side of the frame member 68 which is perpendicular to the opening/closing direction of the arm section, and to which the frame member 68, the support section 32, and the first base section 30 are not attached. Since the attachment position of the frame member 68 can be arbitrarily changed, a position at which the arm section may catch the frame member 68 differs depending on the attachment position of the frame member 68.

2-5. Intermediate Member

Figure 12:
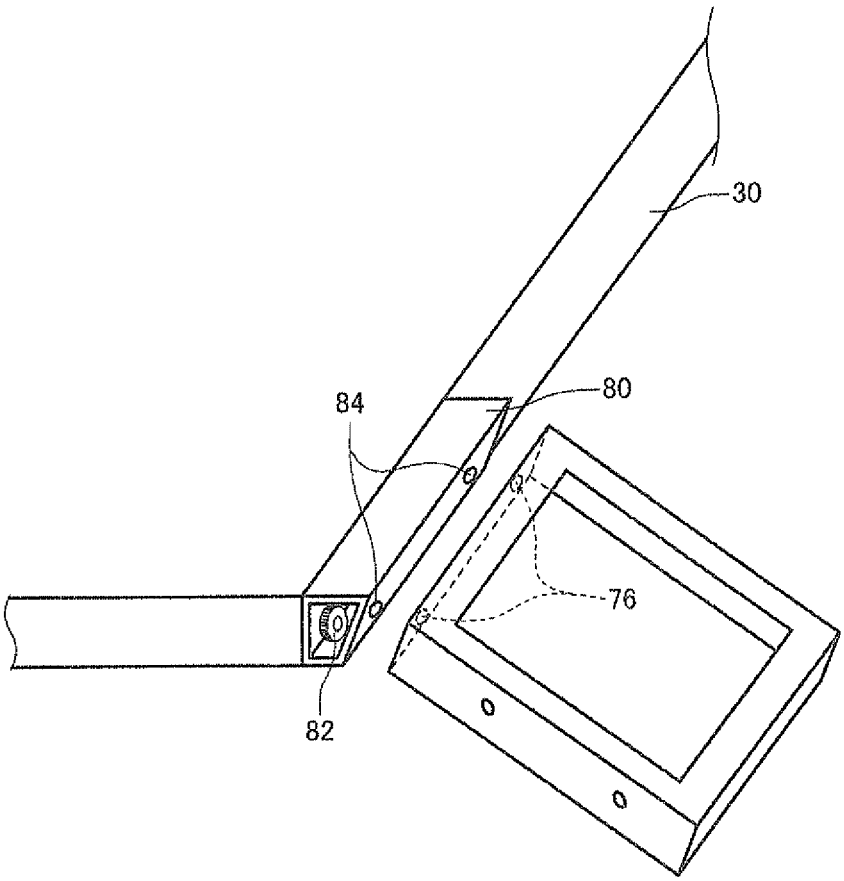
FIG. 12 is a diagram illustrating an intermediate member according to one embodiment of the invention.

FIG. 12 is a diagram illustrating an intermediate member 80 according to one embodiment of the invention. In one embodiment of the invention, the frame member 68 can be attached in a tilted state using the intermediate member 80. As illustrated in FIG. 12, the frame member 68 is attached to the first base section 30 in a tilted state by attaching the frame member 68 to the first base section 30 via the intermediate member 80. The intermediate member 80 is a hollow member having a trapezoidal cross-sectional shape. A screw head 82 is provided inside the intermediate member 80. A screw section is provided through one side of the intermediate member 80. The intermediate member 80 is attached to the first base section 30 using the screw. Holes 84 are formed in the other side of the intermediate member 80. The frame member 68 is attached to the intermediate member 80 by inserting a screw into each hole 84 and each hole of the frame member 68.

Figure 13:
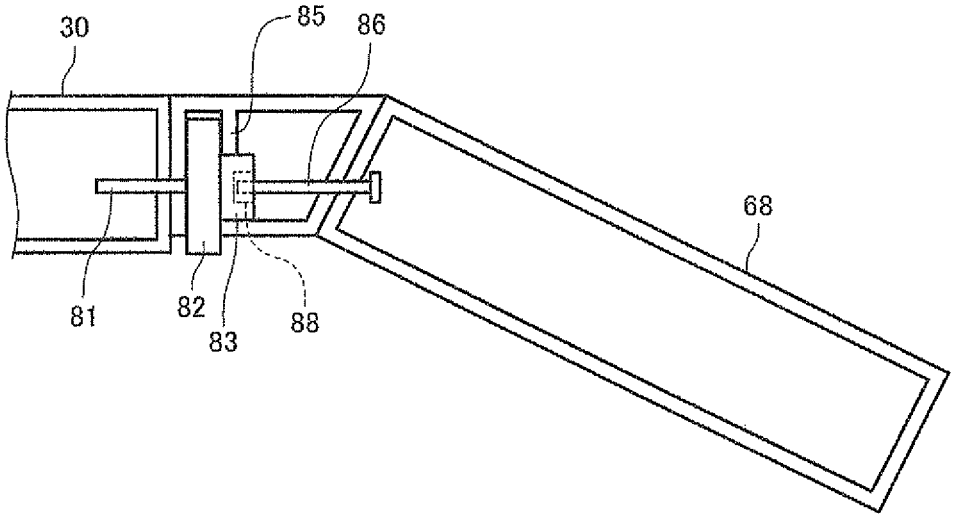
FIG. 13 is a diagram illustrating attachment of an intermediate member according to one embodiment of the invention.

FIG. 13 is a diagram illustrating attachment of the intermediate member 80. As illustrated in FIG. 13, part of the screw head 82 provided inside the intermediate member 80 is exposed through a hole formed in the bottom of the intermediate member 80. The screw can be rotated by utilizing the exposed part. Note that the screw head 82 may be exposed through a hole formed in the upper side of the intermediate member 80. The intermediate member 80 is attached to the first base section 30 using a screw section 81 that protrudes from one end face of the screw head 82. A screw shaft 83 is formed on the other end face of the screw head 82. The screw is supported by the screw section 81 and the screw shaft 83 inside the intermediate member 80. A bearing plate 85 that supports the screw shaft 83 is provided inside the intermediate member 80. Since the intermediate member 80 has a small width, and the holes are formed in each side at an identical interval, the end of the screw shaft 83 comes in contact with the end of a screw 86 for attaching the frame member 68. Therefore, a depression 88 is formed in the screw shaft 83 so that the end of the screw 86 for attaching the frame member 68 is positioned in the depression 88. Therefore, the screw 86 for attaching the frame member 68 can be tightened even if the width of the hollow is reduced.

Figure 14A:
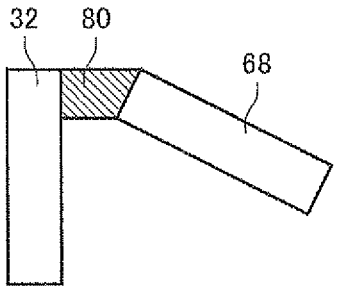
FIG. 14A is a diagram illustrating attachment of an intermediate member according to one embodiment of the invention.
Figure 14B:
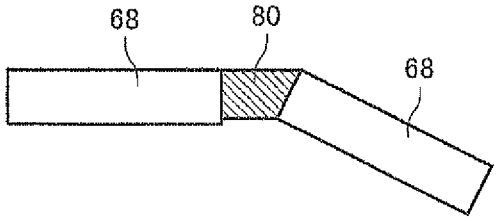
FIG. 14B is a diagram illustrating attachment of an intermediate member according to one embodiment of the invention.
Figure 14C:
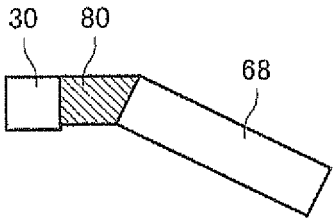
FIG. 14C is a diagram illustrating attachment of an intermediate member according to one embodiment of the invention.
Figure 14D:
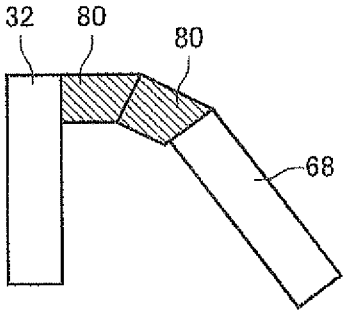
FIG. 14D is a diagram illustrating attachment of an intermediate member according to one embodiment of the invention.

FIGS. 14A to 14D are diagrams illustrating an attachment example of the intermediate member 80. The intermediate member 80 may be provided (attached) between the support section 32 and the frame member 68 (see FIG. 14A), between the frame member 68 and the frame member 68 (see FIG. 14B), or between the first base section 30 and the frame member 68 (see FIG. 14C). As illustrated in FIG. 14D, a plurality of intermediate members 80 may be connected.

2-6. Second Base Section

As illustrated in FIG. 1, two second base sections 90 that are approximately perpendicular to the bottom of the game space are provided on each end (i.e., the outer edge of the prize guiding space) of the rear side of the prize game apparatus 10 according to one embodiment of the invention. A display area can be formed on the rear side of the game space by attaching the support section 32 to the second base section 90.

Figure 15A:
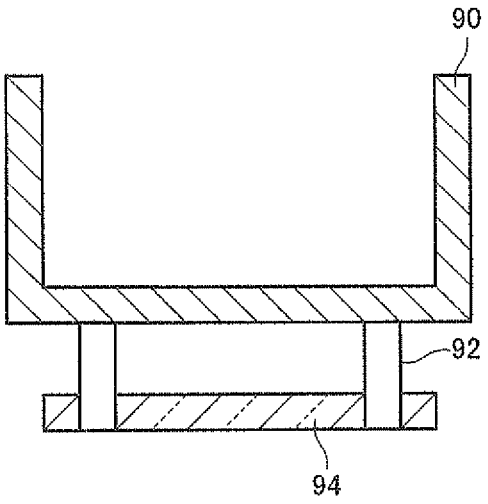
FIG. 15A is a diagram illustrating attachment of a support section to a second base section according to one embodiment of the invention.
Figure 15B:
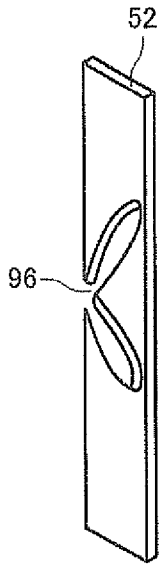
FIG. 15B is a diagram illustrating attachment of a support section to a second base section according to one embodiment of the invention.
Figure 15C:
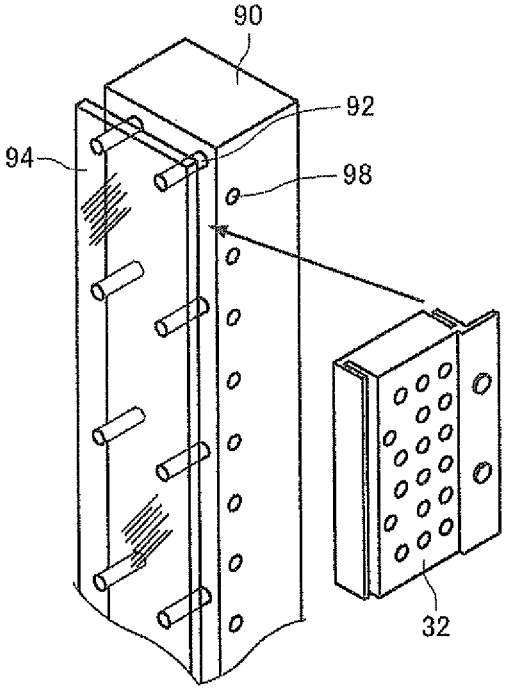
FIG. 15C is a diagram illustrating attachment of a support section to a second base section according to one embodiment of the invention.

FIGS. 15A to 15C are diagrams illustrating attachment of the support section 32 to the second base section 90. FIG. 15A is a top view illustrating the second base section 90. As illustrated in FIG. 15A, a pin 92 (i.e., restriction section) protrudes from the front side of the second base section 90. A front plate 94 (i.e., an intersection placement side that intersects a horizontal plane (second base guide section)) is secured on the end of the pin 92. FIG. 15B is a diagram illustrating the slide plate 52 of the support section 32 from above. As illustrated in FIG. 15B, a slit 96 (i.e., receiving section) is formed in the slide plate 52 of the support section 32. As illustrated in FIG. 15C, the slide plate 52 is inserted into the space formed between the second base section 90 and the front plate 94, and the pin 92 is fitted (slid) into the slit 96 formed in the slide plate 52, so that the support section 32 is supported by the second base section 90. Specifically, the front plate 94 guides the slide plate 52 of the support section 32 slidably along the front plate 94, and the support section 32 receives the pin 92 in the slit 96 in a state in which the slide plate 52 is guided by the front plate 94.

As illustrated in FIG. 15C, a plurality of pins 92 arranged in the vertical direction and the horizontal direction protrude from the front surface of the second base section 90. Therefore, the support section 32 can be supported at an arbitrary height. Since the support section 32 can be attached to the second base section 90 by merely suspending the support section 32 on the second base section 90 without using a screw or the like, the burden imposed on the operator is reduced. In particular, since the second base section 90 is provided along the rear side of the game space, and the operator must lean forward when performing the attachment operation from the front side of the game apparatus, the burden imposed on the operator can be sufficiently reduced. A plurality of threaded holes 98 are formed in the side of the second base section 90. The support section 32 may be attached to the second base section 90 in a more stable way by inserting a screw into the threaded hole 98 and the hole 56 formed in the attachment plate 50 of the support section 32.

Figure 16:
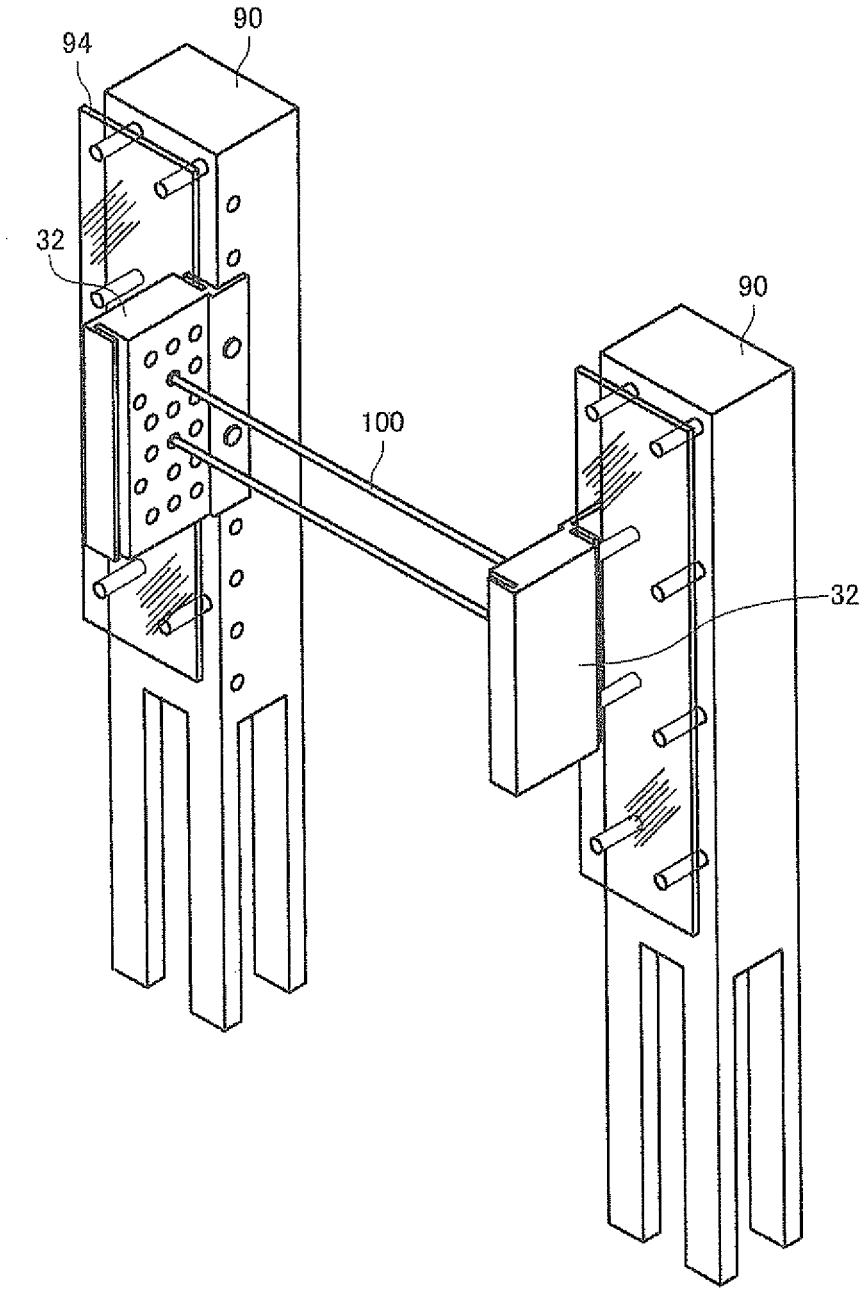
FIG. 16 is a diagram illustrating a rear-side display area according to one embodiment of the invention.
Figure 17:
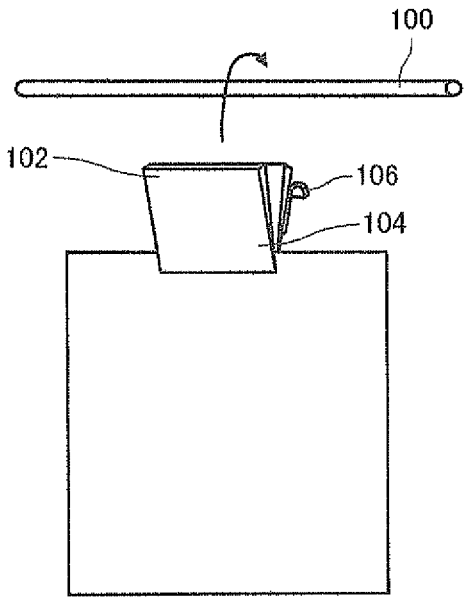
FIG. 17 is a diagram illustrating a clip according to one embodiment of the invention.
Figure 18:
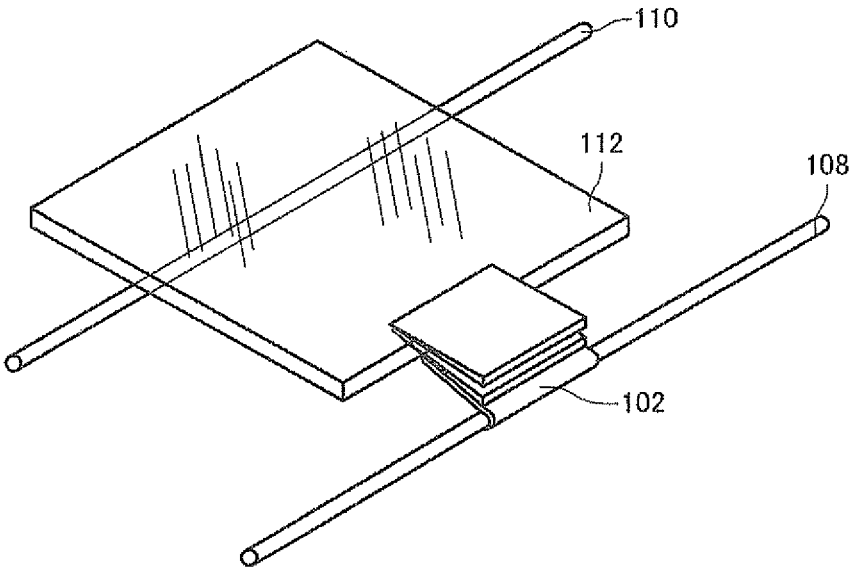
FIG. 18 is a diagram illustrating a rear-side display area according to one embodiment of the invention.

FIG. 16 is a diagram illustrating an example of the display area formed along the rear side of the game space. In the example illustrated in FIG. 16, the support section 32 is attached to each of the right and left second base sections 90, and rod-like members 100 are attached to the support sections 32. A prize or a decoration may be suspended on the rod-like member 100 attached to the support sections 32. A clip 102 illustrated in FIG. 17 may be used to suspend a prize or a decoration. The clip 102 includes a clip section 104 that clips a prize or a decoration, and a clip attachment section 106 used to attach the clip 102 to the rod-like member 100. As illustrated in FIG. 18, two rod-like members 108 and 110 may be attached to the support sections 32 so that the rod-like members 108 and 110 are arranged in the horizontal direction. The clip 102 may be attached to the rod-like member 108, and a plate-like member 112 may be held by the clip 102, and placed on the rod-like member 110 to form a placement section.

2-7. Shelf Member

Figure 19:
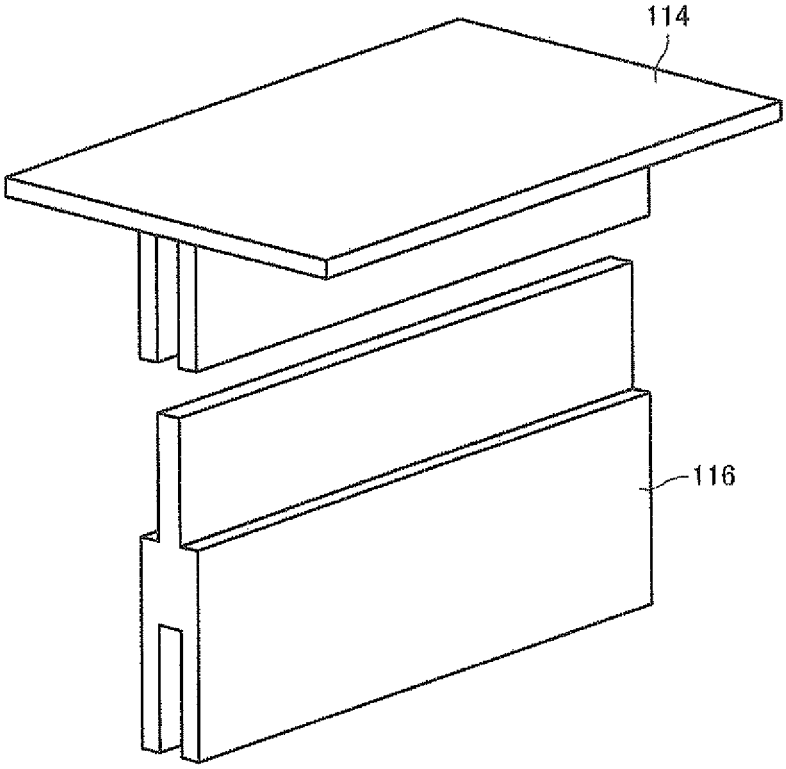
FIG. 19 is a diagram illustrating a center display area according to one embodiment of the invention.

FIG. 19 is a diagram illustrating the structure of the center display area 38. As illustrated in FIG. 1, the center display area 38 is formed on the partition 36 disposed between the right game space 28 and the left game space 29 of the prize game apparatus 10 according to one embodiment of the invention. The center display area 38 is formed as follows. As illustrated in FIG. 19, a shelf member 114 is attached to a shelf support member 116. The shelf support member 116 is attached to the center partition 36.

2-8. Prize Storage Section

Figure 20A:
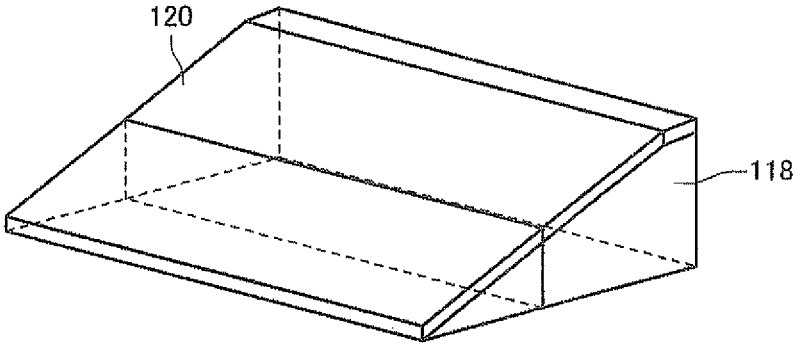
FIG. 20A is a diagram illustrating a prize storage section according to one embodiment of the invention.
Figure 20B:
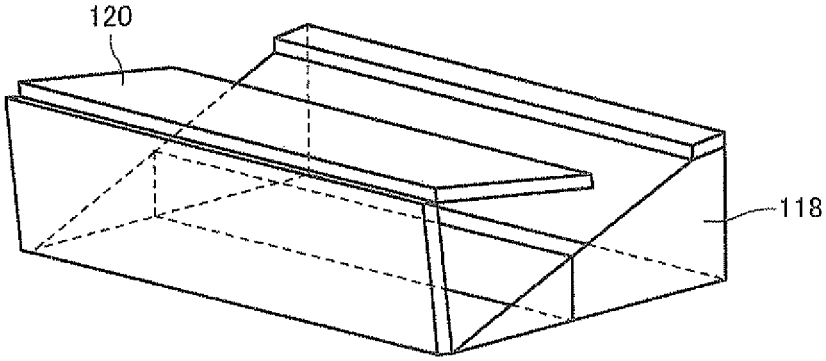
FIG. 20B is a diagram illustrating a prize storage section according to one embodiment of the invention.
Figure 20C:
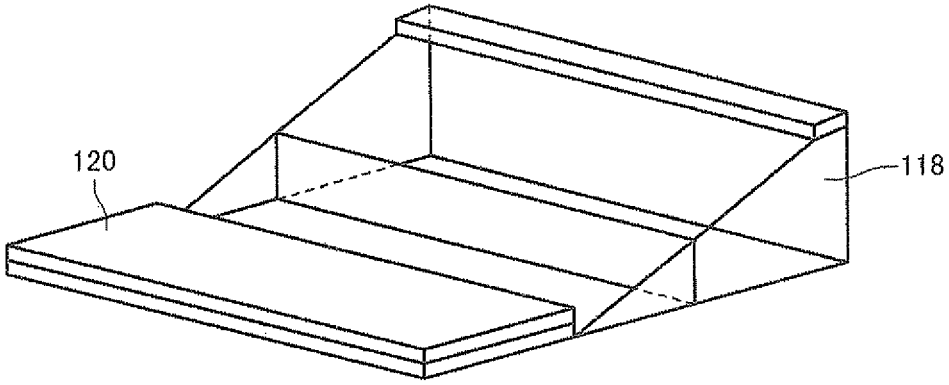
FIG. 20C is a diagram illustrating a prize storage section according to one embodiment of the invention.

FIGS. 20A to 20C are diagrams illustrating a prize storage section. The prize game apparatus 10 according to this embodiment includes a prize storage section 118 that stores the prize and is disposed in the space under the slope that forms the prize guiding space 24. As illustrated in FIGS. 20A to 20C, the slope that forms the bottom of the prize guiding space 24 serves as a lid 120 of the prize storage section 118. The lid 120 can be folded at the center. Therefore, the lid 120 can be opened and closed even if the space over the lid 120 is small (see FIGS. 20A to 20C). Note that the lid 120 may configured to be folded at three or more positions.

Figure 21:
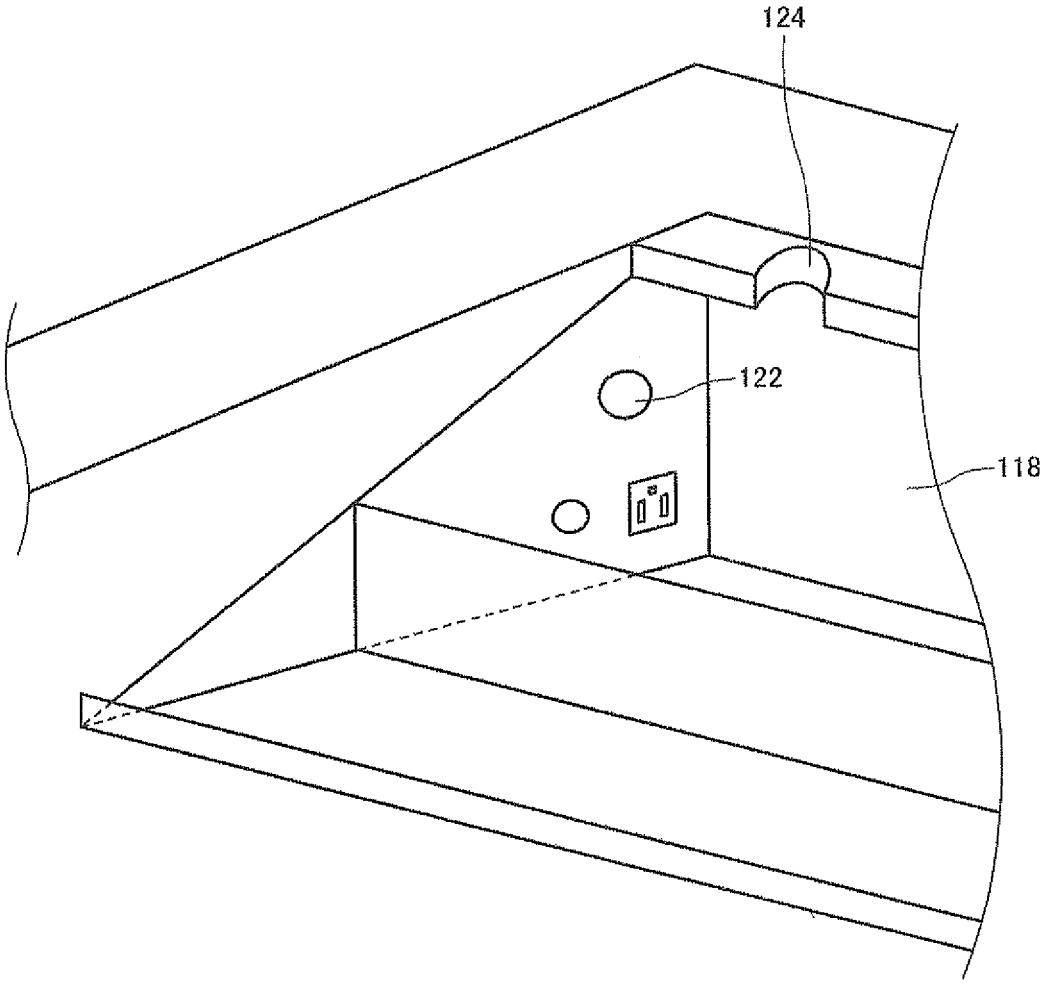
FIG. 21 is a diagram illustrating the inside of a prize storage section according to one embodiment of the invention.

FIG. 21 is a diagram illustrating the inside of the prize storage section 118. A space for storing the prize and the like is formed inside the prize storage section 118. A sound input terminal 122 is provided on the inner wall of the prize storage section 118. A music reproduction device may be disposed in the internal space of the prize storage section 118, and sound may be output from a speaker included in the prize game apparatus 10 by connecting the music reproduction device to the sound input terminal 122. A cut 124 is formed in the upper part of the prize storage section 118. Therefore, even if the music reproduction device is disposed outside the prize storage section 118, the music reproduction device can be connected to the sound input terminal 122 via a cord inserted into the cut 124.

3. Example of Game Field

An example of the game field of the prize game apparatus 10 according to one embodiment of the invention is described below with reference to FIGS. 22 and 23.

Figure 22:
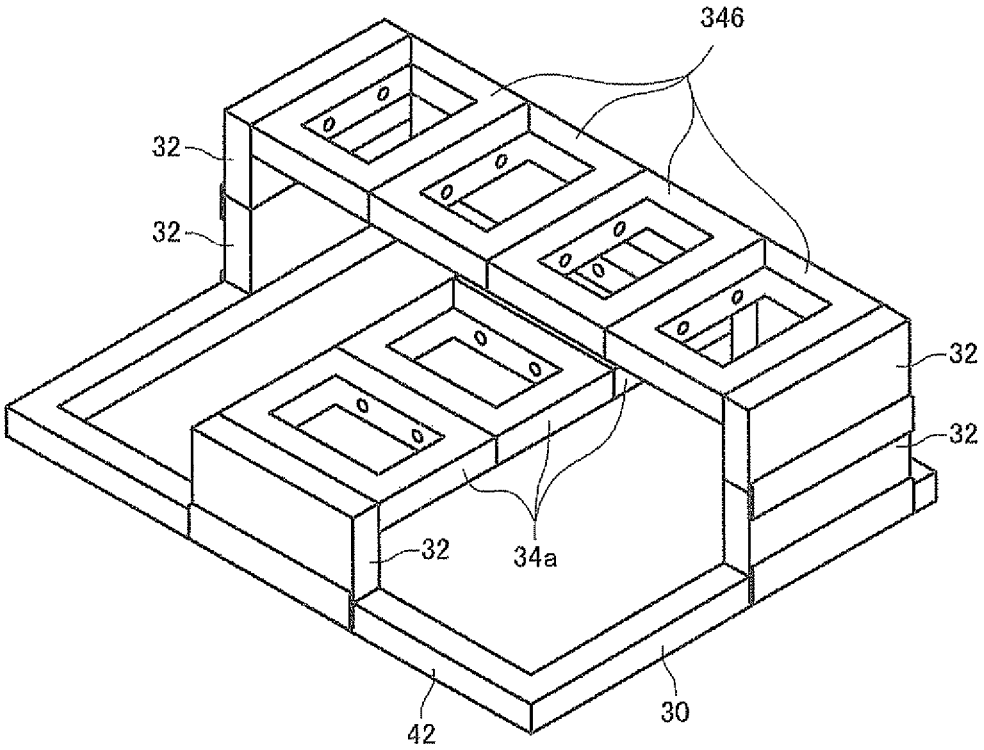
FIG. 22 is a perspective view illustrating an example of a game field of a prize game apparatus according to one embodiment of the invention.

In a game field illustrated in FIG. 22, the bar 42 is attached to the front end of the first base section 30, and prize placement sections 34*a* are disposed at the center of the game space between the bar 42 and the interior side. Prize placement sections 34*b* are disposed on the interior side of the game space over the center prize placement section 34*a*. The prize placement sections 34*b* are disposed at a position higher than that of the center prize placement section 34*a* by connecting two support sections 32. The prize game apparatus 10 according to one embodiment of the invention is thus configured so that the height of the prize placement section can be changed by changing the number of support sections 32 to be connected, so that a game field having a three-dimensional shape can be formed.

Figure 23:
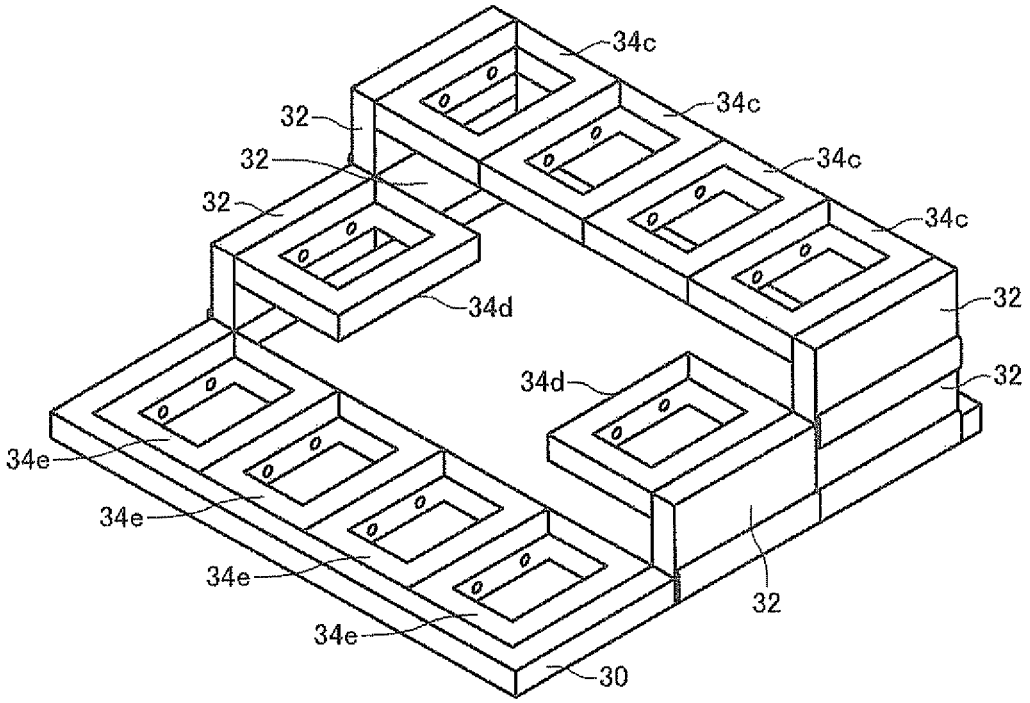
FIG. 23 is a perspective view illustrating an example of a game field of a prize game apparatus according to one embodiment of the invention.

In a game field illustrated in FIG. 23, prize placement sections 34*c* are attached to two support sections 32 attached to the right side of the first base section 30 and two support sections 32 attached to the left side of the first base section 30.

A prize placement section 34*d* is attached to one support section 32 attached to each side of the first base section 30 on the front side of the prize placement sections 34*c*. Prize placement sections 34*e* are disposed between the right side and the left side of the first base section 30 on the front side of the prize placement sections 34*d*. In this case, an open area is formed at the center of the game field. A related-art method may form an open area at the center of the game field. However, the game field formed by a related-art method is planar. When forming a three-dimensional game field as illustrated in FIG. 23, the open area extends in the vertical direction, so the prize easily falls as compared with the case where an open area is formed at the center of the game field using a related-art method. Moreover, since the prizes are disposed at a higher position toward the interior side, the player is given a splendid impression.

4. Block Diagram

Figure 24:
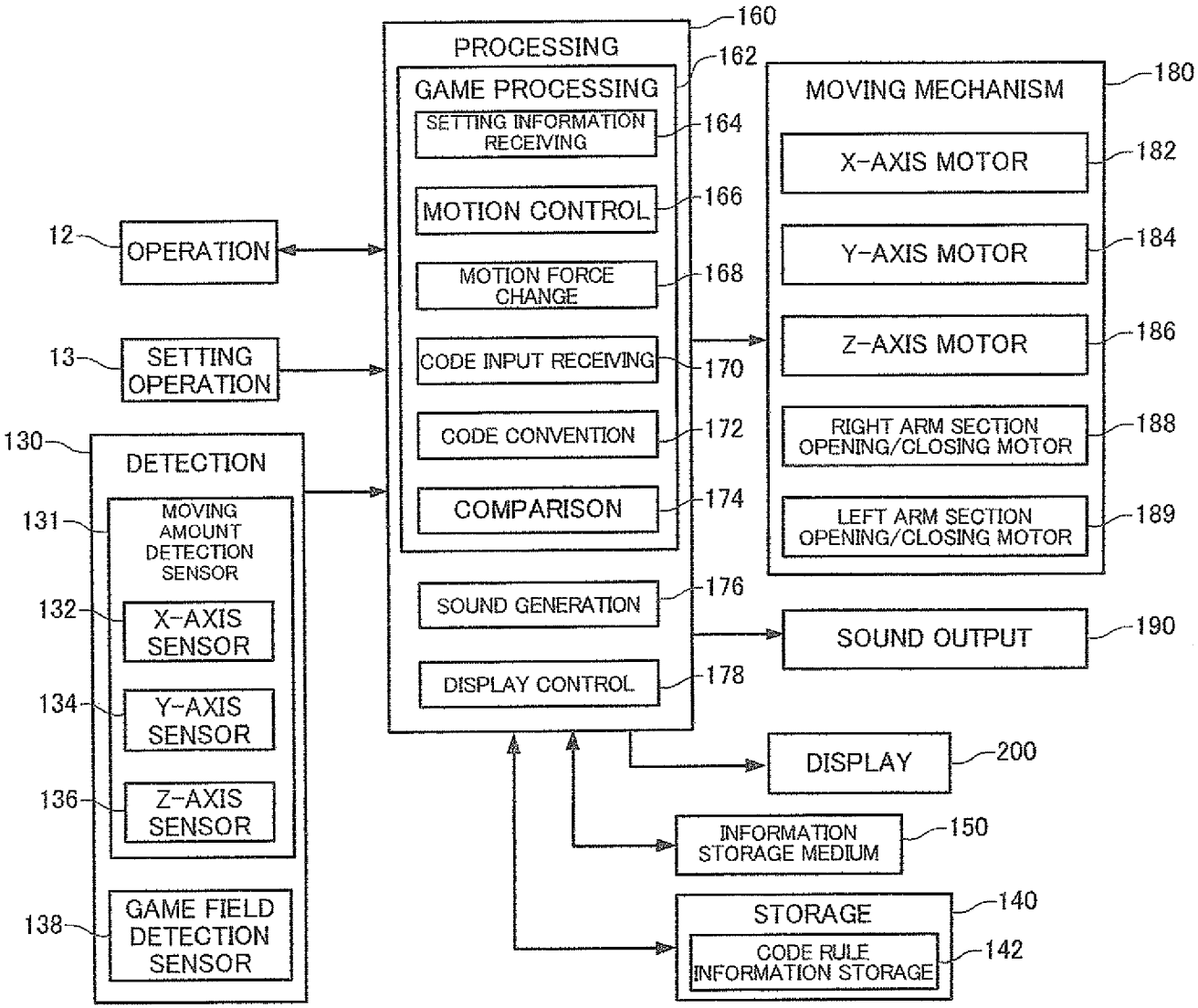
FIG. 24 is a functional block diagram of a prize game apparatus according to one embodiment of the invention.

FIG. 24 is a functional block diagram of the prize game apparatus 10 according to one embodiment of the invention. The prize game apparatus 10 according to one embodiment of the invention includes an operation section 12, a setting operation section 13, a detection section 130, a storage section 140, an information storage medium 150, a processing section 160, a moving mechanism 180, a sound output section 190, and a display section 200.

The operation section 12 may be implemented by an operation button or an operation lever. The operation section 12 receives an operation input from the player, and transmits an operation signal to the processing section 160.

The setting operation section 13 receives a setting input from the operator, and transmits a setting signal to the processing section 160. Examples of the setting input include a setting input that inputs game field layout information, a setting input that inputs a movement start reference position where the prize moving section 14 starts movement, a setting input that inputs a motion force setting of the right and left arm sections 20 and 22 of the prize moving section 14, and the like. The setting operation section 13 may be provided in the housing or the like so that the player cannot operate the setting operation section 13, or the setting input may be performed using the operating section of the operation section 12.

The detection section 130 includes a moving amount detection sensor 131 and a game field detection sensor 138. The moving amount detection sensor 131 includes an X-axis sensor 132, a Y-axis sensor 134, and a Z-axis sensor 136. The moving amount detection sensor 131 detects the moving amount of the prize moving section 14 to detect the position of the prize moving section 14 in the game space 28. The game field detection sensor 138 (i.e., detection section) detects the layout of the game field (i.e., placement of the prize support section) (i.e., the position, size, shape, and the like of the prize placement area and the open area).

The storage section 140 serves as a work area for the processing section 160 and the like. The function of the storage section 140 may be implemented by hardware such as a RAM. A code rule information storage section 142 (i.e., rule information storage section) of the storage section 140 stores rule information that specifies a control code corresponding to each of a plurality of pieces of setting information. Examples of the setting information include placement setting information about placement of the prize placement section 34, motion force setting information about at least one of a first motion force and a second motion force corresponding to the position of the prize moving section 14, change state setting information about a change state of at least one of the first motion force and the second motion force corresponding to the position of the prize moving section 14, and the like. The code rule information storage section 142 stores a different control code corresponding to each of the plurality of pieces of setting information.

The information storage medium 150 (computer-readable storage medium) stores a program and information such as data. The function of the information storage medium 150 may be implemented by hardware such as a magnetic disk, a hard disk, a magnetic tape, a memory (ROM), a magneto-optical disk (MO), or an optical disk (CD or DVD). The processing section 160 performs various processes according to the invention (various embodiments of the invention) based on information stored in the information storage medium 150. Specifically, the information storage medium 150 stores information (program or data) for implementing the means according to the invention (various embodiments of the invention) (particularly blocks included in the processing section 160).

The processing section 160 (processor) includes a game processing section 162, a sound generation section 176, and a display control section 178. The processing section 160 performs various processes such as a game process, a sound generation process, and a display control process based on the operation signal from the operation section 12, a program, and the like. The function of the processing section 160 may be implemented by hardware such as a processor (CPU, DSP, etc.) or an ASIC (gate array, etc.), or a program (game program).

The game processing section 162 includes a setting information receiving section 164, a motion control section 166, a motion force change section 168, a code input receiving section 170, a code convention section 172, and a comparison section 174. The game processing section 162 performs various game processes based on the operation signal from the operation section 12. Examples of the game processes include starting the game based on a game start condition, proceeding with the game, finishing the game when a game finish condition has been satisfied, and the like.

The setting information receiving section 164 (i.e., setting section) receives the setting information including information about the layout of the open area (i.e., placement setting information), and sets the placement setting information based on the setting input (i.e., input information) that has been input to the setting operation section 13, the detection result of the detection section 130, a code (control code) input to the code input receiving section 170 (described later), and the like. The setting information receiving section 164 may set the placement setting information based on the detection result of the game field detection sensor 138.

The motion control section 166 (i.e., movement/motion control section, control section, or motion force control section) controls the motion of the moving mechanism 180 based on the operation signal from the operation section 12, and the setting information received by the setting information receiving section 164. More specifically, the motion control section 166 controls the motion of the prize moving section 14 by controlling the operations of the X-axis motor 182, the Y-axis motor 184, the Z-axis motor 186, a right arm section opening/closing motor 188 (i.e., first driving means), and a left arm section opening/closing motor 189 (i.e., second driving means) included in the moving mechanism 180. Note that the motion control section 166 controls the motion of the moving mechanism 180 based on the operation signal from the operation section 12 operated by the player when performing a positioning motion of the prize moving section 14. The motion control section 166 then automatically controls the moving mechanism 180 based on the setting information when performing a downward moving motion, a prize holding motion, an upward moving motion, a prize transfer motion, a prize release motion, and a return motion.

The motion control section 166 may control at least one of the movement and the motion of the prize moving section 14 based on the placement setting information about placement of the prize placement section 34. The motion control section 166 controls the motion force of the prize moving section 14 based on motion force information. More specifically, the motion control section 166 controls the motion force of the right arm section 20 based on first motion force information, and controls the motion force of the left arm section 22 based on second motion force information.

The motion force change section 168 changes the motion force information based on the motion force setting information about the motion force. Specifically, the motion force change section 168 changes the motion force of each arm section of the prize moving section 14 based on the position of the prize moving section 14 detected by the moving amount detection sensor 131. More specifically, the motion force change section 168 changes the driving force (i.e., first motion force information) of the right arm section opening/closing motor 188 and the driving force (i.e., second motion force information) of the left arm section opening/closing motor 189 to independently change the motion force of each arm section.

In one embodiment of the invention, the motion force change section 168 changes at least one of the first motion force information and the second motion force information based on the position of the prize moving section 14. The motion force change section 168 may change at least one of the first motion force information and the second motion force information in a change state corresponding to the position of the prize moving section 14.

The setting information receiving section 164 (setting section) may set the change state setting information about at least one of the first motion force information and the second motion force information corresponding to the position of the prize moving section 14 based on the input information input to the setting operation section 13, and the motion force change section 168 may change at least one of the first motion force information and the second motion force information in a change state corresponding to the position of the prize moving section 14 based on the change state setting information.

The motion force change section 168 may change the second motion force information so that the motion force of the left arm section 22 decreases when changing the first motion force information so that the motion force of the right arm section 20 increases, and may change the second motion force information so that the motion force of the left arm section 22 increases when changing the first motion force information so that the motion force of the right arm section 20 decreases.

The motion force change section 168 may swap the first motion force information and the second motion force information based on the position of the prize moving section 14.

The code input receiving section 170 receives a code that consists of a plurality of symbols and has been input to the setting operation section 13.

The code convention section 172 (i.e., setting section) generates setting information based on the code (i.e., control code) received by the code input receiving section 170 and the code rule information, and sets the generated setting information to be the setting information used by the motion control section 166 and the motion force change section 168. The code convention section 172 generates a code based on the setting information (i.e., input setting information) received by the setting information receiving section 164 and the code rule information, and sets the generated code to be the setting information used by the motion control section 166 and the motion force change section 168. Specifically, the code convention section 172 sets the placement setting information, the motion force setting information, and the change state setting information based on the input code.

The comparison section 174 determines whether or not the detection result of the game field detection sensor 138 coincides with the setting input that has been input to the setting operation section 13.

The display control section 178 displays the generated code and setting information on the display section 200. Specifically, the display control section 178 refers to the rule information stored in the rule information storage section based on the input information, and displays the control code corresponding to the input information on the display section.

The sound generation section 176 performs a sound process based on the results of various processes performed by the processing section 160 to generate game sound such as background music (BGM), effect sound, or voice, and outputs the generated game sound to the sound output section 190.

The sound output section 190 outputs the sound generated by the sound generation section 176, and sound input to the sound input terminal 122 provided inside the prize storage section 118.

The moving mechanism 180 includes the X-axis motor 182, the Y-axis motor 184, the Z-axis motor 186, and the arm section opening/closing motor 188. The moving mechanism 180 moves the prize moving section 14, and opens and closes the arm section based on a control signal from the motion control section 166.

5. Motion of Prize Moving Section 14

5-1. X-Y-Axis Movement

Figure 25A:
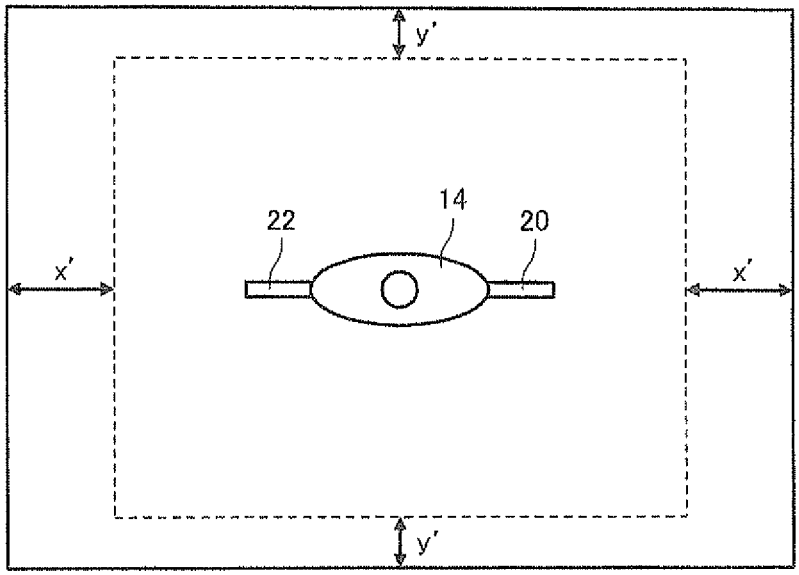
FIG. 25A is a diagram illustrating limitations to the moving range of prize moving section according to one embodiment of the invention.
Figure 25B:
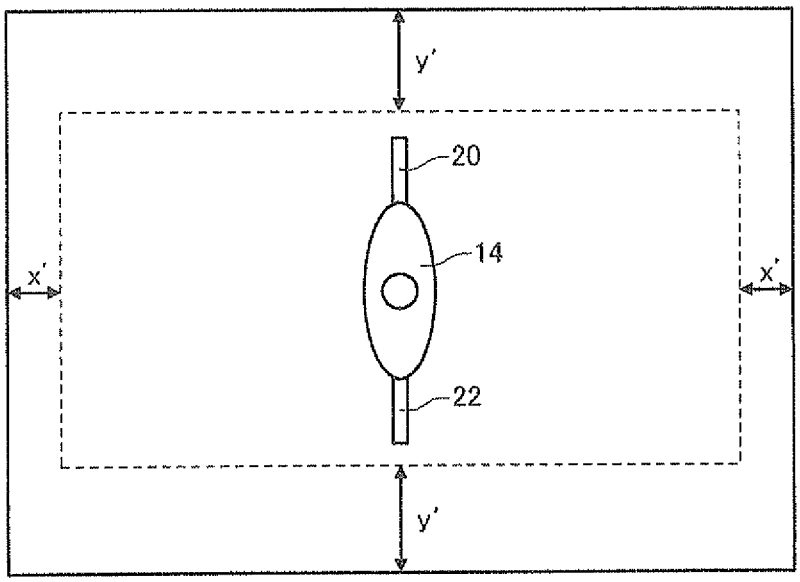
FIG. 25B is a diagram illustrating limitations to the moving range of prize moving section according to one embodiment of the invention.

FIGS. 25A and 25B are diagrams illustrating limitations to the moving range of the prize moving section 14. The prize game apparatus 10 according to one embodiment of the invention is configured so that the X-axis motor 182, the Y-axis motor 184, and the Z-axis motor 186 included in the moving mechanism 180 operate based on the control signal from the motion control section 166 to move the prize moving section 14. The moving range of the prize moving section 14 is limited. The moving range of the prize moving section 14 may be limited by the operator using the setting operation section 13, or may be automatically limited by the processing section 160 based on the detection result of the detection section 130 and the like.

The limitations to the moving range of the prize moving section 14 are described in detail below. The X-axis moving range and the Y-axis moving range are limited so that the prize moving section 14 does not collide with the inner wall of the housing. In FIG. 25A, the movable range of the prize moving section 14 is indicated by a dotted line. As illustrated in FIG. 25A, the width (x') of the Immovable range in the X-axis direction is larger than the width (y') of the unmovable range in the Y-axis direction so that the arm sections 20 and 22 that make an opening/closing motion do not collide with the inner wall. When the player moves the prize moving section 14 by operating the operation section 12, the prize moving section 14 is compulsorily stopped so that the prize moving section 14 does not move beyond the movable range.

The prize game apparatus 10 according to one embodiment of the invention is configured so that the attachment direction of the prize moving section 14 can be changed. When the attachment direction of the prize moving section 14 has been changed, the moving range of the prize moving section 14 is automatically changed. FIG. 25B illustrates a change in the moving range of the prize moving section 14 when the attachment direction of the prize moving section 14 has been changed. As illustrated in FIG. 25B, when the prize moving section 14 has been rotated by 90° from the state illustrated in FIG. 25A, the width of the unmovable range in the X-axis direction is automatically changed to y', and the width of the unmovable range in the Y-axis direction is automatically changed to x'. Therefore, the arm sections that make an opening/closing motion do not collide with the inner wall even if the opening/closing direction of the arm sections has been changed.

5-2. Z-Axis Movement

The prize game apparatus 10 according to one embodiment of the invention is configured so that the moving range of the prize moving section 14 in the Z-axis direction can also be set. For example, the descent position of the prize moving section 14 can be limited (Z-descent limit). Therefore, since the descent position of the prize moving section 14 can be made constant, the player can easily acquire the prize when playing a game that allows the player to acquire the prize suspended on the rod-like member using the end of the arm section, for example. When limiting the descent position of the prize moving section 14, the descending speed of the prize moving section 14 may be reduced when the prize moving section 14 has approached the limit position. This makes it possible for the player to perform a delicate operation when the prize moving section 14 has approached the limit position, so that the player can easily acquire the prize.

Figure 26:
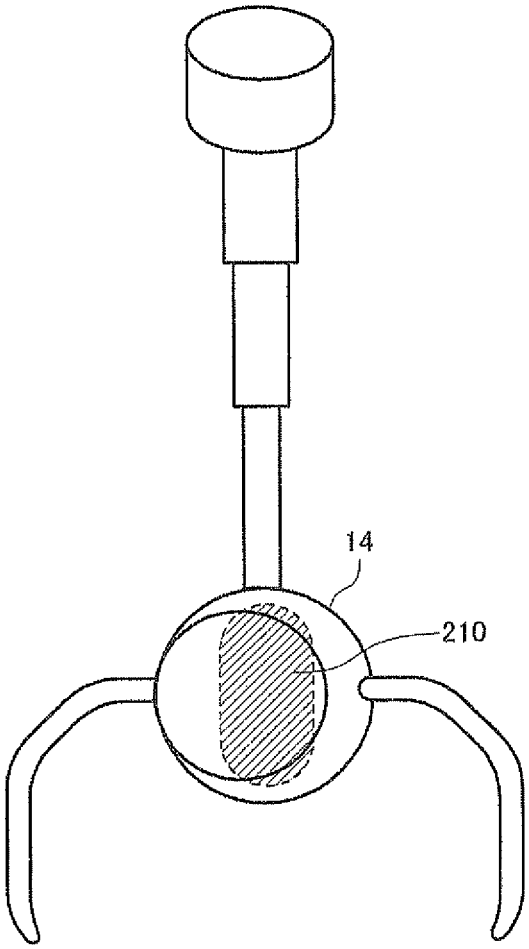
FIG. 26 is a diagram illustrating attachment of a weight to a prize moving section according to one embodiment of the invention.

FIG. 26 is a diagram illustrating the prize moving section 14. As illustrated in FIG. 26, a space 210 for attaching a weight is formed in the prize moving section 14, and a weight can be fitted into the space 210.

When the descent position is not limited, or the prize placement area is formed above the descent limit position, the prize moving section 14 stops the descending movement when the prize moving section 14 has come in contact with the prize placement area or the prize placed on the prize placement area. Specifically, when the prize moving section 14 has come in contact with the prize placement area or the prize placed on the prize placement area, and it has been detected that the amount of looseness of a wire from which the prize moving section 14 is suspended has become equal to or larger than a given value, the prize moving section 14 stops the descending movement. Therefore, the prize moving section 14 stops the descending movement when some time has elapsed after the prize moving section 14 has come in contact with the prize placement area or the prize placed on the prize placement area. In one embodiment of the invention, the above time can be adjusted by attaching a weight to the prize moving section 14. Specifically, the time that elapses until the prize moving section 14 stops the descending movement after the prize moving section 14 has come in contact with the prize placement area or the prize placed on the prize placement area can be increased by attaching a weight to the prize moving section 14. This is because the prize moving section 14 continues the descending movement so as to sink into the prize placement area or the prize placed on the prize placement area due to the weight of the prize moving section 14 (i.e., it takes time for the wire to loosen) after the prize moving section 14 has come in contact with the prize placement area or the prize placed on the prize placement area.

5-3. Opening/Closing Motion of Arm Section

In one embodiment of the invention, the prize moving section 14 includes the right arm section 20 (first aim section) and the left arm section 22 (second arm section), and holds and moves the prize utilizing the opening/closing motion of the arm sections. The motion force of the opening/closing motion is set to each of the right arm section 20 and the left arm section 22. The motion force of the right arm section 20 and the motion force of the left arm section 22 change based on the position of the prize moving section 14 detected by the detection section 130. This makes it possible to change the effect of the arm section on the prize based on the position of the prize moving section 14. For example, the prize is more (less) easily held. The prize is moved by the arm sections even when the prize cannot be held by the opening/closing motion of the arm sections. In this case, the direction in which the prize is moved by the arm sections changes when the motion force of the right arm section 20 and the motion force of the left arm section 22 have changed.

Figures 27A, 27B:
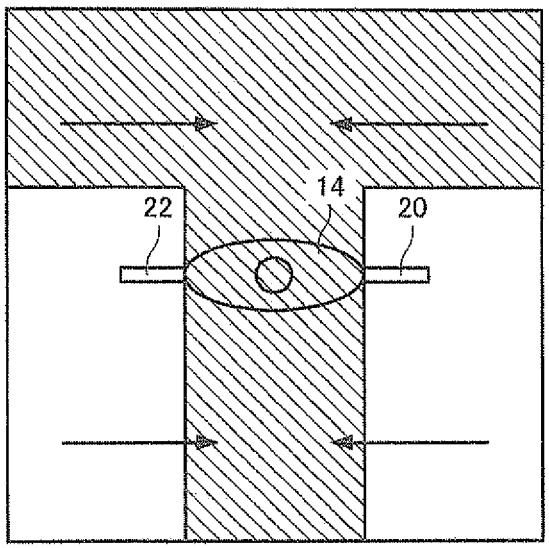
FIG. 27A is a diagram illustrating a change in motion force of an arm section and a prize moving direction according to one embodiment of the invention.
FIG. 27B is a diagram illustrating a change in motion force of an arm section and a prize moving direction according to one embodiment of the invention.

FIGS. 27A and 27B are diagrams illustrating an example of the control process that changes the motion force of the prize moving section 14. FIG. 27A is a top view of the game field. In FIG. 27A, a shaded area indicates the prize placement area, and a blank area indicates the open area. FIG. 27B illustrates an example of the setting information for changing the motion force. The setting information illustrated in FIG. 27B is input by the operator using the setting operation section 13, for example. In the setting information illustrated in FIG. 27B, the game field is divided into four areas, and a motion force change control state is set corresponding to each area. The motion force change control process includes swapping the motion force of the right arm section 20 and the motion force of the left arm section 22. Specifically, setting information "NORMAL" illustrated in FIG. 27B indicates that each of the right arm section 20 and the left arm section 22 makes a motion with the initial motion force, and setting information "REVERSE" illustrated in FIG. 27B indicates that the initial motion force of the right arm section 20 and the initial motion force of the left arm section 22 are swapped (i.e., the left arm section 22 makes a motion with the initial motion force set to the right arm section 20, and the right arm section 20 makes a motion with the initial motion force set to the left arm section 22). The following description is given taking an example in which the initial motion force set to the right arm section 20 is 70, and the initial motion force set to the left arm section 22 is 30. The force applied to the prize by the arm section via an opening/closing motion increases as the motion force increases.

In the example illustrated in FIGS. 27A and 27B, the right arm section 20 makes an opening/closing motion with a motion force of 70, and the left arm section 22 makes an opening/closing motion with a motion force of 30 in the right half of the game field to which the setting information "NORMAL" is set. Therefore, when the prize could not be held by the right arm section 20 and the left arm section 22, it is likely that the prize is moved to the left by the right arm section 20 with a higher motion force. On the other hand, the right arm section 20 makes an opening/closing motion with a motion force of 30, and the left arm section 22 makes an opening/closing motion with a motion force of 70 (i.e., the initial motion force of the right arm section 20 and the initial motion force of the left arm section 22 are swapped) in the left half of the game field to which the setting information "REVERSE" is set. Therefore, when the prize could not be held by the right arm section 20 and the left arm section 22, it is likely that the prize is moved to the right by the left arm section 22 with a higher motion force. Accordingly, the prizes are easily accumulated at the center of the game field (see arrows in FIG. 27A). As illustrated in FIG. 27A, the prize placement area is formed at the center of the game field. Therefore, the prizes are moved to the center of the placement area, and rarely fall into the open area when using the game field illustrated in FIG. 27A and the setting illustrated in FIG. 27B.

Figures 28A, 28B:
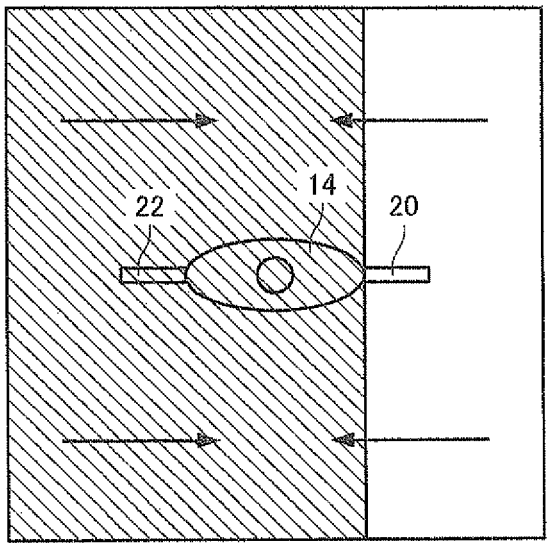
FIG. 28A is a diagram illustrating a change in motion force of an arm section and a prize moving direction according to one embodiment of the invention.
FIG. 28B is a diagram illustrating a change in motion force of an arm section and a prize moving direction according to one embodiment of the invention.

FIGS. 28A and 28B are diagrams illustrating another example of the control process that changes the motion force of the prize moving section 14. As illustrated in FIG. 28B, the setting information is the same as that illustrated in FIG. 27B. Therefore, the prizes are likely to be moved in the directions indicated by the arrows illustrated in FIG. 27A. However, since the shape of the game field illustrated in FIG. 28A differs from that illustrated in FIG. 27A, the game playability differs from that of the example illustrated in FIGS. 27A and 27B. In the example illustrated in FIG. 28A, when the player desires to acquire the prize placed on the left end of the game field, it is likely that the prize is moved to approach the open area when the prize is positioned on the left side with respect to the center of the game field, but is moved away from the open area when the prize is positioned on the right side with respect to the center of the game field. This makes it possible to implement game playability in which the player cannot easily acquire the prize that appears to be easily acquired.

Figure 29A:
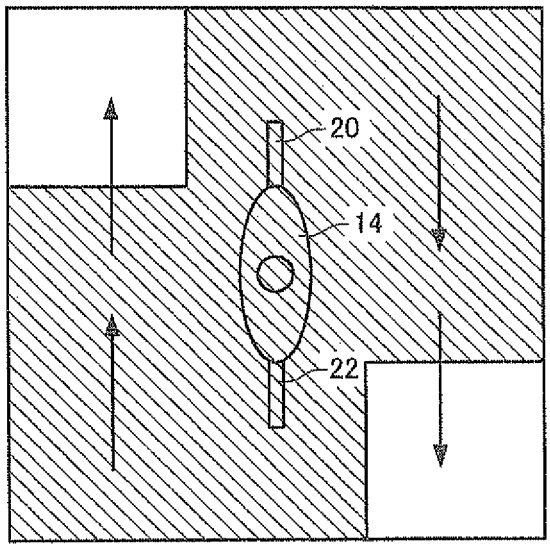
FIG. 29A is a diagram illustrating a change in motion force of an arm section and a prize moving direction according to one embodiment of the invention.
Figure 29B:
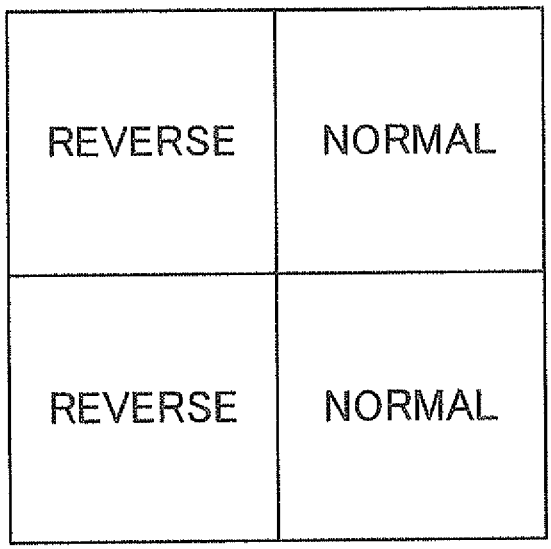
FIG. 29B is a diagram illustrating a change in motion force of an arm section and a prize moving direction according to one embodiment of the invention.

FIGS. 29A and 29B are diagrams illustrating another example of the control process that changes the motion force of the prize moving section 14. As illustrated in FIG. 29B, the setting information is the same as that illustrated in FIGS. 27B and 28B. As illustrated in FIG. 29A, the prize moving section 14 is rotated by 90° from the state illustrated in FIGS. 27A and 28A. Therefore, it is likely that the prize is moved to the front side by the right arm section 20 in the right half of the game field to which the setting information "NORMAL" is set. On the other hand, it is likely that the prize is moved to the interior side by the left arm section 22 in the left half of the game field to which the setting information "REVERSE" is set. As illustrated in FIG. 29A, the open areas are formed on the right front side and the left interior side of the game field. Therefore, the prizes are moved to approach the open area, and easily fall into the open area.

Figures 30A, 30B:
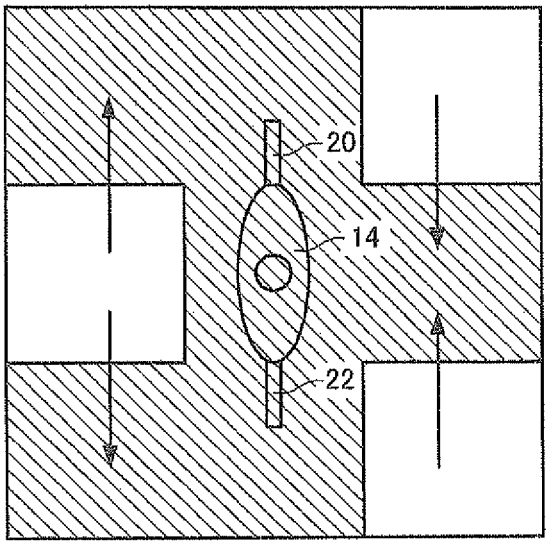
FIG. 30A is a diagram illustrating a change in motion force of an arm section and a prize moving direction according to one embodiment of the invention.
FIG. 30B is a diagram illustrating a change in motion force of an arm section and a prize moving direction according to one embodiment of the invention.

FIGS. 30A and 30B are diagrams illustrating yet another example of the control process that changes the motion force of the prize moving section 14. As illustrated in FIG. 30A, the prize moving section 14 is disposed at the same angle as that illustrated in FIG. 29A. However, the setting information illustrated in FIG. 30B differs from that illustrated in FIG. 29B. As illustrated in FIG. 30B, the setting information "REVERSE" is set to the right front area of the game field. Therefore, it is likely that the prize is moved to the interior side of the game field by the left arm section 22. The setting information "NORMAL" is set to the right interior area of the game field. Therefore, it is likely that the prize is moved to the front side of the game field by the right arm section 20. Likewise, it is likely that the prize is moved to the front side in the left front area of the game field, and is moved to the interior side in the left interior area of the game field. FIG. 30A illustrates the shape of the game field and arrows that indicate the directions in which the prizes are likely to be moved. As illustrated in FIG. 30A, the prizes are likely to be moved to away from the open area, and rarely fall into the open area.

According to one embodiment of the invention, the game playability and the difficulty level of the prize game can thus be adjusted by performing the control process that changes the motion force of the right arm section and the motion force of the left arm section based (depending) on the position of the prize moving section 14.

Figure 31:
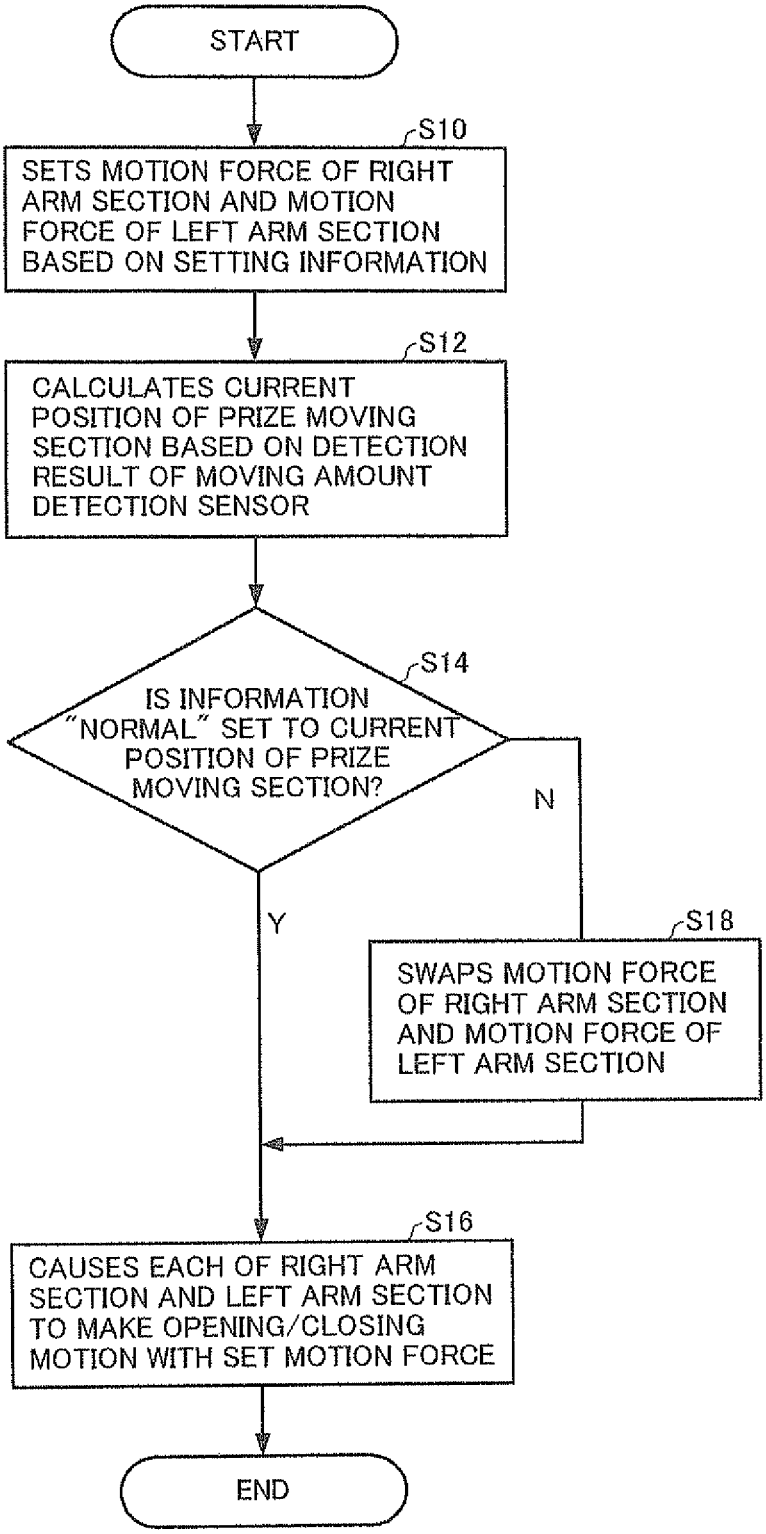
FIG. 31 is a flowchart illustrating the flow of a process performed by a motion control section according to this embodiment.

FIG. 31 is a flowchart illustrating the flow of the process performed by the motion control section 166 according to one embodiment of the invention. The game apparatus sets the motion force of the right arm section 20 and the motion force of the left arm section 22 based on the setting information received by the setting information receiving section 164 (step S10). The game apparatus then calculates the current position of the prize moving section 14 based on the detection result of the moving amount detection sensor 131 (step S12). The game apparatus then refers to the setting information used for the motion force change control process, and determines whether or not the information set to the current position of the prize moving section 14 is "NORMAL" (step S14). When the game apparatus has determined that the information set to the current position of the prize moving section 14 is "NORMAL" (step S14: Y), the game apparatus causes each of the right arm section 20 and the left arm section 22 to make an opening/closing motion with the set motion force (step S16). When the game apparatus has determined that the information set to the current position of the prize moving section 14 is not "NORMAL" (step S14: N), the game apparatus swaps the motion force of the right arm section 20 and the motion force of the left arm section 22 (step S18), and causes each of the right arm section 20 and the left arm section 22 to make an opening/closing motion with the set motion force (step S16).

6. Setting Information and Code

FIG. 32 is a table illustrating an example of the setting information received by the setting information receiving section 164. The motion control section 166 controls the motion of the prize moving section 14 based on the setting information received by the setting information receiving section 164, as described above. The operator can input the setting information illustrated in FIG. 32 by operating the setting operation section 13. In FIG. 32, the setting information "ARM POWER RIGHT" indicates the motion force of the right arm section 20. The setting information "ARM POWER LEFT" indicates the motion force of the left arm section 22. The setting information "ARM OPENING" indicates the maximum angle formed by the arm sections as a result of the opening/closing motion. The setting information "ARM POWER SWAP" indicates information for performing the motion force change control process based on the position of the prize moving section 14. As illustrated in FIG. 27B, for example, the setting information "NORMAL" or "REVERSE" can be set to each area of the game field. Therefore, the number of combinations is 16. The setting information "PRIZE PIT" indicates information (i.e., layout information) about the position of the open area. In one embodiment of the invention, the game field is divided into nine areas (3×3), and each area can be set to the open area or the prize placement area. Since at least one open area must be set to the game field, the number of combinations is 511. The setting information "CHARGE SETTING" indicates the charge for the prize game.

The motion control process on the prize moving section 14 and various game processes are performed based on the setting information. Note that two prize game apparatuses 10 according to one embodiment of the invention may be connected. In this case, the game apparatuses have a symmetrical coordinate system. Therefore, the prize moving section 14 makes a symmetrical motion even if identical setting information is set to the game apparatuses.

A wide variety of game playability can be implemented using the prize game apparatus 10 according to one embodiment of the invention by arbitrarily combining the above setting items. When it has been found that the setting of one game apparatus is suitable for the player and the operator, the operator may desire to apply that setting to another game apparatus. A setting suitable for the player and the operator may be a setting that provides the player with an exciting game, a setting that provides a moderate difficulty level that ensures that the player is satisfied with the game player while bringing the operator in an appropriate income, or the like. In one embodiment of the invention, the setting information including the above setting items can be input and output as a code that consists of a plurality of symbols so that the setting of one game apparatus can be easily set to another game apparatus.

The code output process is described below with reference to FIG. 32. As illustrated in FIG. 32, each setting item is indicated by a 32 hex value (i.e., symbol). When the operator has input the setting information, the setting information is received, and a code is generated by linking each setting item indicated by a 32 hex value. A rule (i.e., code rule information) that indicates an item (value) linking method is stored in the code rule information storage section 140. The value of each item is linked in accordance with the rule. As illustrated in FIG. 32, priority A, B, or C is set to each setting item. The setting item set to the priority A must be set, while the setting item set to the priority B or C may not necessarily be set. Therefore, the number of figures of the code is obtained by summing up the number of figures (9) of each setting item that is set to the priority A and the number of figures of each setting item that is set to the priority B or C and has been set by the operator. The generated code is displayed on the display section 200 provided around the setting operation section 13.

Figure 33:
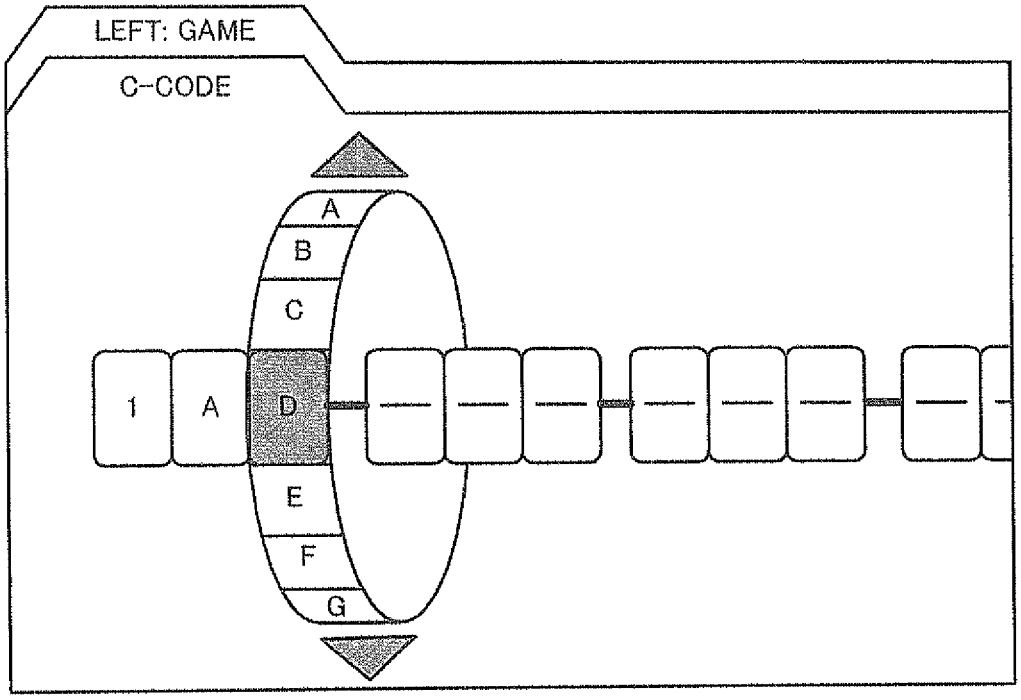
FIG. 33 is a diagram illustrating an example of a code input screen according to one embodiment of the invention.

The code input process is described below with reference to FIG. 33. FIG. 33 is a diagram illustrating an example of a code input screen displayed on the display section 200. As illustrated in FIG. 33, a plurality of blank boxes are displayed on the display section 200. The operator inputs a symbol to each blank box by operating the setting operation section 13. When the operator has input a code, the input values are interpreted in accordance with the code rule information to generate the setting information, and the generated setting information is received. The display section 200 may be a touch panel, and a code may be input by a touch operation.

The above code input/output process makes it possible to easily apply the setting of one game apparatus to another game apparatus.

Figure 34:
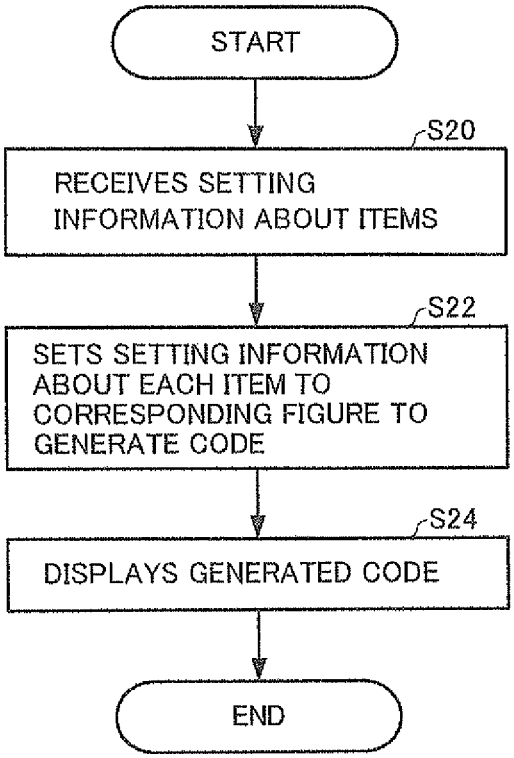
FIG. 34 is a flowchart illustrating the flow of a code output process according to this embodiment.

FIG. 34 is a flowchart illustrating the flow of the code output process. The game apparatus receives the setting information about a plurality of items (step S20). The game apparatus then sets the setting information about each item to the corresponding figure to generate a code (step S22). The game apparatus then displays the generated code (step S24).

Figure 35:
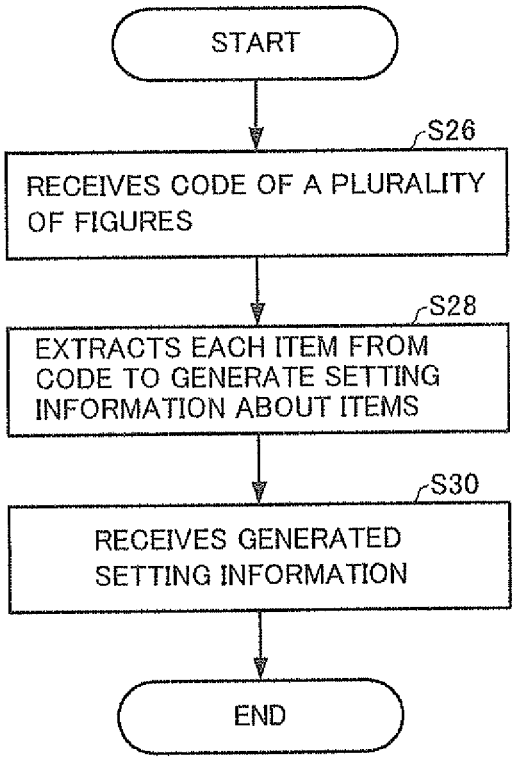
FIG. 35 is a flowchart illustrating the flow of a code input process according to this embodiment.

FIG. 35 is a flowchart illustrating the flow of the code input process. The game apparatus receives a code of a plurality of figures (step S26). The game apparatus then extracts each item from the code to generate setting information about a plurality of items (step S28). The game apparatus then receives the generated setting information (step S30).

7. Detection of Game Field

In one embodiment of the invention, the shape of the game field can be automatically detected using the game field detection sensor 138. Specifically, the shape of the game field is detected by causing the prize moving section 14 to automatically make an upward/downward moving motion in each of the nine areas (3×3) of the game field. An area is determined to be the prize placement area when the prize moving section 14 that has made a downward moving motion has collided with the prize placement section 34, and is determined to be the open area when the prize moving section 14 that has made a downward moving motion has not collided with the prize placement section 34. When the prize moving section 14 has collided with the prize placement section 34, the moving amount of the prize moving section 14 in the Z-axis direction may be detected to determine the height of the prize placement section 34.

The setting information "PRIZE PIT" or "Z-DESCENT LIMIT" among the setting items illustrated in FIG. 32 may be automatically set based on the detection result independently of the operation of the operator. It is also possible to determine whether or not the item set by the operator coincides with the actual layout of the game field.

8. Modifications

The methods described in connection with the above embodiments are merely examples. The scope of the invention also includes a method that achieves effects similar to those of the methods described in connection with the above embodiments. The invention is not limited to the above embodiments. Various modifications and variations may be made. Various methods described in connection with the above embodiments and modifications thereof may be appropriately used in combination as a method that implements the invention.

8-1. Support Section

The above embodiments have been described taking an example of inserting a screw into the hole 56 formed in the attachment plate 50 and the hole 58 formed in the first base section. Note that the screw may be attached to the attachment plate 50. This prevents a situation in which the screw is lost.

Figure 36:
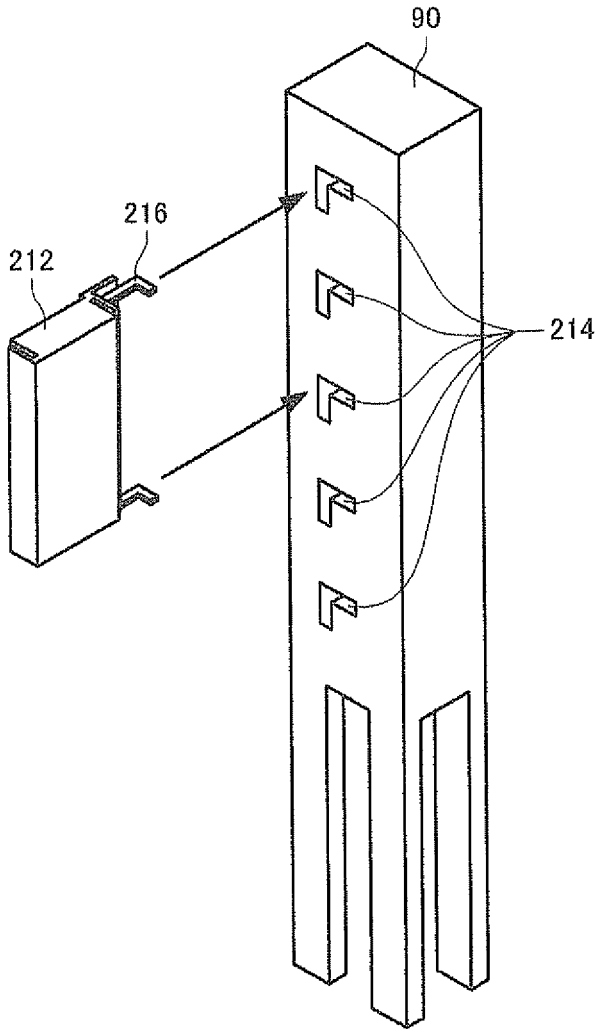
FIG. 36 is a diagram illustrating attachment of a support section according to a modification to a second base section.

The above embodiments have been described taking an example in which the slide plate 52 is provided at the bottom of the main body 47, and the support section 32 is temporarily placed on the first base section 30, or the support section 32 is suspended from the second base section 90 using the slide plate 52. Note that an L-shaped protrusion may be formed at the bottom of the main body instead of forming the slide plate 52. In this case, a hole into which the L-shaped protrusion is fitted is formed in the upper side of the first base section 30 and the front side of the second base section 90, and the support section is attached to the first base section 30 or the second base section 90 by inserting the L-shaped protrusion into the hole. FIG. 36 is a diagram illustrating an example of attaching a support section 212 according to this modification to the second base section 90. As illustrated in FIG. 36, a plurality of holes 214 having a shape obtained by rotating the character "L" by 90° are formed in the front side of the second base section 90. An L-shaped protrusion 216 formed on the support section 212 is inserted into the upper part of the hole, and the support section 212 is moved downward so that the support section 212 is suspended from the second base section 90.

8-2. Prize Placement Section

Figure 37:
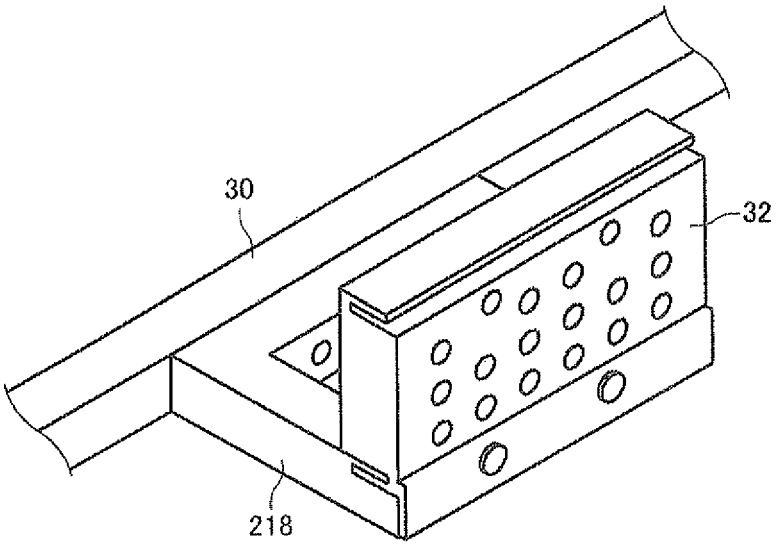
FIG. 37 is a diagram illustrating attachment of a frame member according to a modification.

The above embodiments have been described taking an example in which the frame member 68 of the prize placement section 34 is attached to the first base section 30 or the upper part of the side of the support section 32. Note that the frame member may be attached to the attachment plate 50 of the support section 32. FIG. 37 illustrates an example in which a frame member 218 according to this modification is attached to the first base section 30 and the attachment plate 50 of the support section 32. The frame member 218 can be attached to the attachment plate 50 of the support section 32, the upper part of the side of the support section 32, and the base section. Specifically, the first attachment section, the second attachment section, and the third attachment section are holes having an identical size and an identical shape, and allow insertion of the same screw. Therefore, prize placement areas that differ in shape can be formed by attaching the frame member 218 to various areas of the game space.

Figure 38:
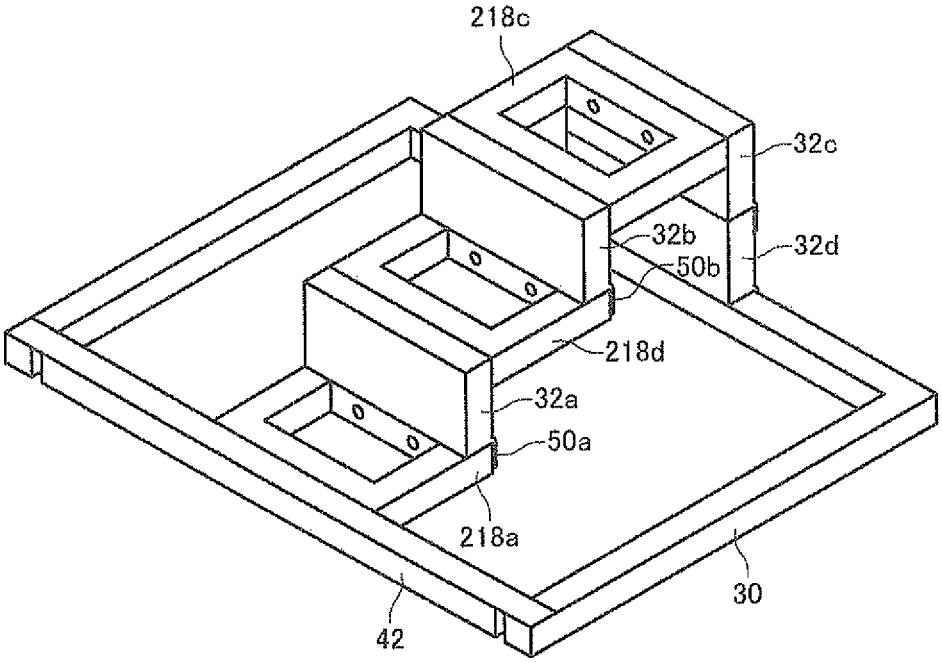
FIG. 38 is a diagram illustrating an example of a game field of a prize game apparatus according to a modification.

FIG. 38 illustrates an example of a game field that is formed using the frame member 218 that can be attached to the attachment plate 50 of the support section 32, the upper part of the side of the support section 32, and the first base section 30. In the game field illustrated in FIG. 38, the bar 42 is attached to the front end of the first base section 30, and two support sections 32*c* and 32*d* are attached to the interior side of the first base section 30. A frame member 218*a* is attached to the side of the bar 42 attached to the front end of the first base section 30, and an attachment plate 50*a* of a support section 32*a* is attached to the side of the frame member 218*a* opposite to the side attached to the first base section 30. A frame member 218*b* is attached to the upper part of the side of the support section 32*a*, and an attachment plate 50*b* of a support section 32*b* is attached to the side of the frame member 218*b* opposite to the side attached to the upper part of the side of the support section 32*a*. A frame member 218*c* is attached to the upper part of the side of the support section 32*b*, and the upper part of the side of the support section 32*c* is attached to the side of the frame member 218*c* opposite to the side attached to the upper part of the side of the support section 32*b*. When the prize placement area has such a shape, the player is given an impression that the prize easily falls into the open area on each side of the game field. Moreover, since the prizes are disposed at a higher position toward the interior side, the player is given a splendid impression.

The above embodiments have been described taking an example in which the prize placement section 34 includes two plate-like members. Note that the prize placement section 34 may include only one plate-like member. In this case, a pattern or the like may be drawn on the plate-like member instead of disposing a sheet on which a pattern or the like may be drawn between two plate-like members.

Figure 39:
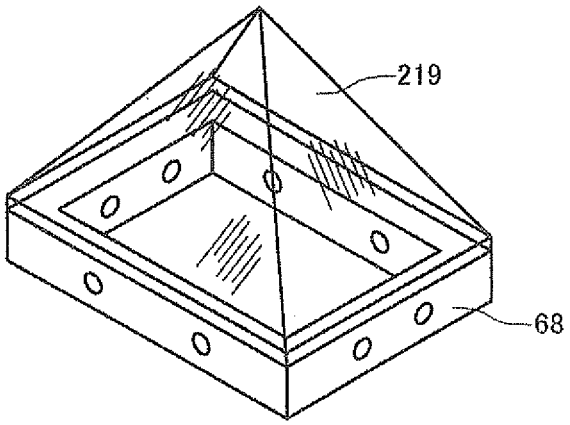
FIG. 39 is a diagram illustrating a prize placement section according to a modification.

The prize placement section 34 may include a member having a three-dimensional shape illustrated in FIG. 39 instead of the plate-like member. FIG. 39 illustrates an example in which a three-dimensional member 219 having a quadrangular pyramid shape is disposed on the frame member 68. It is possible to provide novel game playability (i.e., the prize is placed on a slope) by utilizing a member having a three-dimensional shape.

Figure 40:
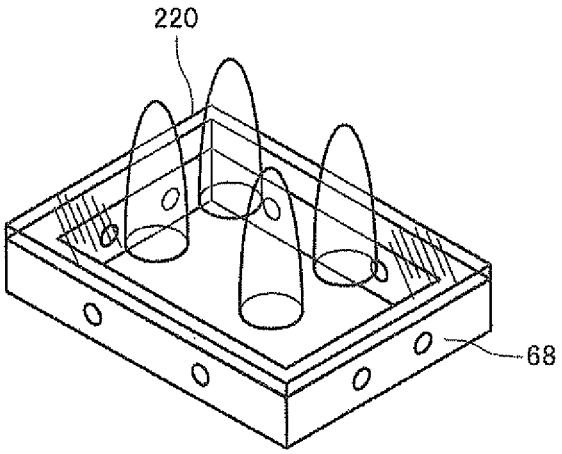
FIG. 40 is a diagram illustrating a prize placement section according to a modification.

As illustrated in FIG. 40, a plate-like member 220 provided with the prizes (i.e., a plate-like member in which the prizes are inserted into holes) may be disposed on the frame member 68. This makes it possible to provide novel game playability in which the player removes the prize from the hole. If the prizes are distributed in a state in which the prizes are attached to the plate-like member, it suffices that the operator to merely dispose the purchased plate-like member 220 on the frame member 68 (i.e., it is necessary to separately place the prizes). This reduces the burden imposed on the operator.

8-3. Shelf Member

The above embodiments have been described taking an example in which the shelf member 114 positioned on the center partition 36 is located outside the moving range of the prize moving section 14, and the player cannot acquire the prize placed on the shelf member 114. Note that the shelf member 114 may be disposed within the moving range of the prize moving section 14 so that the player cant acquire the prize placed on the shelf member 114. For example, the prize game apparatus may be configured so that the player can operate right and left prize moving sections 14 at the same time, and hold the prize placed on the shelf member 114 positioned on the center partition 36 using the right and left prize moving sections 14.

8-4. Opening/Closing Motion of Arm Section

The above embodiments have been described taking an example in which the game field is divided into four areas, and the information "NORMAL" or "REVERSE" is set to each area. Note that the game field may be divided into two or nine areas, for example. A value that is added to or subtracted from the motion force may be set as the motion force change control state instead of the information "NORMAL" or "REVERSE". In this case, since a value that is added to or subtracted from the motion force of the right arm section 20 and a value that is added to or subtracted from the motion force of the left arm section 22 must be set to each area, the amount of information doubles as compared with the case of setting the information "NORMAL" or "REVERSE".

The above embodiments have been described taking an example in which the arm sections are driven (i.e., caused to make an opening/closing motion) using the right arm section opening/closing motor 188 and the left arm section opening/closing motor 189. Note that the arm sections may be driven using another method. For example, the right arm section and the left arm section may be caused to make an opening motion using one motor, the right arm section may be caused to make a closing motion using a right arm section-driving spring, and the left arm section may be caused to make a closing motion using a left arm section-driving spring. In this case, the motion force change means changes the motion force of the right arm section-driving spring and the motion force of the left arm section-driving spring.

8-5. Detection of Game Field

The above embodiments have been described taking an example in which the shape of the game field is detected by causing the prize moving section 14 to automatically make an upward/downward moving motion. Note that the shape of the game field may be detected by another method. For example, an infrared sensor may be used as the game field detection sensor 138. Alternatively, the shape of the game field may be detected by analyzing a captured image of the game space.

8-6. Others

The moving range of the prize moving section 14 may be visually indicated using a laser beam. The moving range of the prize moving section 14 may also be indicated using the sheet 74 disposed between the plate-like members of the prize placement section 34.

The above embodiments have been described taking an example in which the upper area of the prize guiding space 24 is open in a rectangular shape over a range corresponding to almost the entire area of the game field. Note that the open range and the open shape of the prize guiding space 24 may be set in various ways.

The above embodiments have been described taking an example in which the prize placement section 34 having the prize placement size is disposed over the prize guiding space 24. Note that a member having a different shape may be used as the prize support section in addition to (or instead of) the prize placement section 34. For example, a rod-like member (i.e., prize support section) that extends over the dimension of the prize guiding space 24 may be supported by a plurality of support sections over the prize guiding space 24. The prize may be disposed over the prize guiding space 24 by horizontally or vertically disposing such a member over the prize guiding space 24, and suspending or sandwiching the prize using such a member.

The above embodiments have been described taking an example in which the right arm section 20 and the left arm section 22 rotate or move relative to the moving section provided with the right arm section 20 and the left arm section 22. Note that one motion section may be rotatably or movably provided to the moving section, or three or more motion sections may be rotatably or movably provided to the moving section.

The above embodiments have been described taking an example in which the right arm section 20 and the left arm section 22 rotate or move relative to the moving section in the first direction and the second direction, respectively. Note that the right arm section 20 and the left arm section 22 may rotate relative to the moving section in one direction, or may move in one direction around the moving section.

REFERENCE SIGNS LIST

10: prize game apparatus, 12: operation section, 13: setting operation section, 14: prize moving section, 16: prize placement area, 17: open area, 18: prize, 20: arm section, 22: arm section, 24: prize guiding space, 26: prize outlet, 28: game space, 29: game space, 30: first base section, 32: support section, 34: prize placement section, 36: partition, 38: center display area, 40: prize, 42: bar, 43: depression, 44: pillar member, 46: lever, 47: main body, 48: hole, 50: attachment plate, 52: slide plate, 54: first groove, 56: first attachment section, 57: second attachment section, 58: third attachment section, 60: second groove, 62: another support section, 64: slide plate of another support section, 66: attachment plate of another support section, 68: frame member, 70: first plate-like member, 72: second plate-like member, 74: sheet, 76: frame-side attachment section, 78: arm stop member, 80: intermediate member, 81: screw section, 82: screw head, 83: screw shaft, 84: hole, 85: bearing plate, 86: screw, 88: depression, 90: second base section, 92: pin, 94: front plate, 96: slit, 98: hole, 100: rod-like member, 102: clip, 104: clip section, 106: clip attachment section, 108: rod-like member, 110: rod-like member, 112: plate-like member, 114: shelf member, 116: shelf support member, 120: lid, 122: sound input terminal, 124: cut, 130: detection section, 131: moving amount detection sensor, 132: X-axis sensor, 134: Y-axis sensor, 136: Z-axis sensor, 138: game field detection sensor, 140: storage section, 142: code rule information storage section, 150: information storage medium, 160: processing section, 162: game processing section, 164: setting information receiving section, 166: motion control section, 168: motion force change section, 170: code input receiving section, 172: code convention section, 174: comparison section, 176: sound generation section, 178: display control section, 180: moving mechanism, 182: X-axis motor, 184: Y-axis motor, 186: Z-axis motor, 188: right arm section opening/closing motor, 189: left arm section opening/closing motor, 190: sound output section, 200: display section, 210: space, 212: support section, 214: hole, 216: protrusion, 218: frame member, 219: three-dimensional member, 220: plate-like member provided with prize

The invention claimed is:

1. A game apparatus comprising:

a prize support section that supports a prize;

a prize moving section that moves the prize supported by the prize support section by making a movement and a motion;

a prize outlet that allows a player to remove the prize;

a prize guiding space that guides the prize toward the prize outlet;

a control section that controls the movement and the motion of the prize moving section based on operation information, and controls a motion force of the prize moving section based on motion force information; and a motion force change section that changes the motion force information based on a position of the prize moving section.

2. The game apparatus according to claim 1, further comprising:

a setting section that sets motion force setting information about a motion force corresponding to the position of the prize moving section based on input information, wherein the motion force change section changes the motion force information based on the position of the prize moving section and the motion force setting information set by the setting section.

3. The game apparatus according to claim 2, further comprising:

a storage section that stores a plurality of pieces of the motion force setting information, wherein the setting section sets the motion force setting information corresponding to the input information based on the input information.

4. The game apparatus according to claim 3, further comprising:

a display control section that displays a display object on a display section, wherein the storage section stores rule information that specifies a control code corresponding to each of the plurality of pieces of motion force setting information; and wherein the display control section displays the control code corresponding to the input information on the display section based on the input information and the rule information.

5. The game apparatus according to claim 4, further comprising:

a placement section, the prize support section being placed on the placement section so that placement of the prize support section can be changed over the prize guiding space, wherein the prize support section supports the prize over the prize guiding space;

the prize moving section makes a movement and a motion over the prize guiding space;

the storage section stores a plurality of pieces of placement setting information about placement of the prize support section, and rule information that specifies a control code corresponding to each of the plurality of pieces of placement setting information;

the setting section receives the control code as the input information, and sets the placement setting information corresponding to the received control code based on the received control code and the rule information; and the control section controls at least one of the movement and the motion of the prize moving section based on the placement setting information set by the setting section.

6. The game apparatus according to claim 4, wherein the storage section stores rule information that specifies a control code corresponding to each of the plurality of pieces of motion force setting information; and wherein the setting section receives the control code as the input information, and sets the motion force setting information corresponding to the received control code based on the received control code and the rule information.

7. The game apparatus according to claim 6, further comprising:

a placement section, the prize support section being placed on the placement section so that placement of the prize support section can be changed over the prize guiding space, wherein the prize support section supports the prize over the prize guiding space;

the prize moving section makes a movement and a motion over the prize guiding space;

the storage section stores a plurality of pieces of placement setting information about placement of the prize support section, and rule information that specifies a control code corresponding to each of the plurality of pieces of placement setting information;

the setting section receives the control code as the input information, and sets the placement setting information corresponding to the received control code based on the received control code and the rule information; and the control section controls at least one of the movement and the motion of the prize moving section based on the placement setting information set by the setting section.

8. The game apparatus according to claim 3, wherein the storage section stores rule information that specifies a control code corresponding to each of the plurality of pieces of motion force setting information; and wherein the setting section receives the control code as the input information, and sets the motion force setting information corresponding to the received control code based on the received control code and the rule information.

9. The game apparatus according to claim 8, further comprising:

a placement section, the prize support section being placed on the placement section so that placement of the prize support section can be changed over the prize guiding space, wherein the prize support section supports the prize over the prize guiding space;

the prize moving section makes a movement and a motion over the prize guiding space;

the storage section stores a plurality of pieces of placement setting information about placement of the prize support section, and rule information that specifies a control code corresponding to each of the plurality of pieces of placement setting information;

the setting section receives the control code as the input information, and sets the placement setting information corresponding to the received control code based on the received control code and the rule information; and the control section controls at least one of the movement and the motion of the prize moving section based on the placement setting information set by the setting section.

10. The game apparatus according to claim 1, wherein the prize moving section includes a first motion section that makes a motion in a first direction, and a second motion section that makes a motion in a second direction;

the control section controls a motion force of the first motion section based on first motion force information, and controls a motion force of the second motion section based on second motion force information; and the motion force change section changes at least one of the first motion force information and the second motion force information based on the position of the prize moving section.

11. The game apparatus according to claim 10, wherein the motion force change section changes the second motion force information so that the motion force of the first motion section decreases when changing the first motion force information so that the motion force of the first motion section increases; and wherein the motion force change section changes the second motion force information so that the motion force of the second motion section increases when changing the first motion force information so that the motion force of the first motion section decreases.

12. The game apparatus according to claim 11, wherein the first direction is opposite to the second direction.

13. The game apparatus according to claim 10, wherein the motion force change section exchanges the first motion force information and the second motion force information based on the position of the prize moving section.

14. The game apparatus according to claim 13, wherein the first direction is opposite to the second direction.

15. The game apparatus according to claim 10, wherein the first direction is opposite to the second direction.

* * * * *